US011440163B2

(12) United States Patent
Buck

(10) Patent No.: US 11,440,163 B2
(45) Date of Patent: Sep. 13, 2022

(54) COMPOUNDLESS ABRASIVE POLISHING OR BUFFING ARTICLE

(71) Applicant: OSBORN, LLC, Richmond, IN (US)

(72) Inventor: Gary S. Buck, Bellbrook, OH (US)

(73) Assignee: OSBORN, LLC, Richmond, IN (US)

( * ) Notice: Subject to any disclaimer, the term of this patent is extended or adjusted under 35 U.S.C. 154(b) by 0 days.

(21) Appl. No.: 16/630,281

(22) PCT Filed: Jul. 10, 2018

(86) PCT No.: PCT/US2018/041532

§ 371 (c)(1),
(2) Date: Jan. 10, 2020

(87) PCT Pub. No.: WO2019/014282

PCT Pub. Date: Jan. 17, 2019

(65) Prior Publication Data

US 2020/0215665 A1 Jul. 9, 2020

Related U.S. Application Data

(60) Provisional application No. 62/530,531, filed on Jul. 10, 2017.

(51) Int. Cl.
*B24D 3/28* (2006.01)
*B24D 11/00* (2006.01)
(Continued)

(52) U.S. Cl.
CPC ..... *B24D 3/28* (2013.01); *B24D 11/001* (2013.01); *B24D 13/08* (2013.01);
(Continued)

(58) Field of Classification Search
CPC .. B24D 13/08; B24D 11/001; B24D 18/0027; B24D 3/344; B24D 18/0009
See application file for complete search history.

(56) References Cited

U.S. PATENT DOCUMENTS 6,758,727 B2 * 7/2004 Coad ..... B24B 19/226 451/28
2002/0002026 A1 1/2002 Molnar
(Continued)

FOREIGN PATENT DOCUMENTS

WO 01-62442 8/2001
WO 2014-070468 5/2014

*Primary Examiner* — Pegah Parvini
(74) *Attorney, Agent, or Firm* — McDonald Hopkins LLC

(57) ABSTRACT

A compoundless buff and method of making a compoundless buff using a coating solution formulated with abrasive particles dispersed or suspended using a surfactant or suspension agent and which also contains a self-crosslinking acrylic binder emulsion that binds abrasive particles to nonwoven cloth of a buffing article when the coating solution is applied thereto forming a relatively hard abrasive-containing coating that enables the buffing article to abrasively treat a surface without having to separately apply any buffing or polishing compound. A preferred coating solution formulation further contains a lubricant emulsion that produces a lubricant and abrasive-containing coating of the buff having lubricant interspersed with binder and abrasive particles thereby reducing friction during buffing or polishing. A preferred coating solution also contains at least one surfactant to disperse the abrasive, suspension agent to keep the abrasive suspended, and buffering agent to keep the pH of the solution so it remains flowable.

12 Claims, 3 Drawing Sheets

Figure 1:
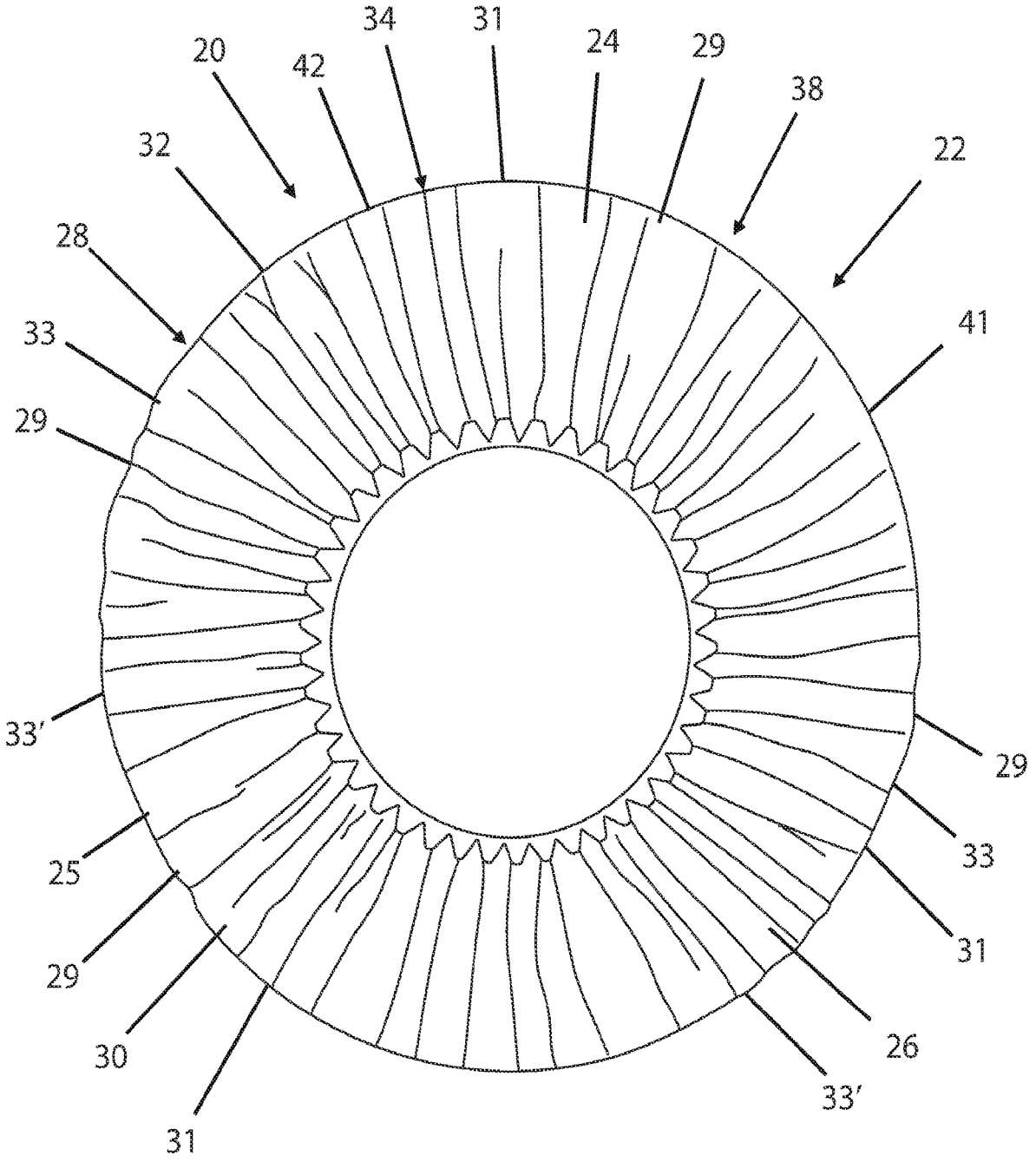

(51) Int. Cl.
*B24D 13/08* (2006.01)
*B24D 18/00* (2006.01)
*B24D 3/34* (2006.01)

(52) U.S. Cl.
CPC ..... *B24D 18/0027* (2013.01); *B24D 3/344* (2013.01); *B24D 18/0009* (2013.01)

(56) References Cited

U.S. PATENT DOCUMENTS

| | | | | |
|---|---|---|---|---|
| 2002/0026752 | A1* | 3/2002 | Culler | B24D 3/28 451/539 |
| 2002/0077037 | A1 | 6/2002 | Tietz | |
| 2002/0098763 | A1* | 7/2002 | Yoshikawa | B32B 5/22 442/340 |
| 2010/0107509 | A1 | 5/2010 | Guiselin | |
| 2013/0252520 | A1* | 9/2013 | Martinez | B24D 13/147 451/532 |
| 2014/0099871 | A1 | 4/2014 | Moren et al. | |
| 2016/0001422 | A1* | 1/2016 | Meana-Esteban | B24B 37/22 451/539 |

* cited by examiner

COMPOUNDLESS ABRASIVE POLISHING OR BUFFING ARTICLE

CROSS REFERENCE

Pursuant to 35 U.S.C. § 119(e), this application claims all benefits to and priority in U.S. Provisional Application Ser. No. 62/530,531, filed on Jul. 10, 2017, the entirety of which is hereby expressly incorporated by reference herein.

FIELD

The present invention is directed to a polishing or buffing article and more particularly to a compoundless buffing or polishing article that includes an abrasive that is adhered to and supported by a working face thereof, a method of making such a buffing or polishing article, and a method of making an abrasive-containing coating applied to the working face to adhere abrasive thereto.

BACKGROUND

Abrasive products come in all kinds of types, forms, shapes and sizes and are used by numerous industries and professions to carry out a wide variety of residential, commercial and industrial surface finishing treatment applications to abrasively remove material from an object or surface being treated, such as by grinding, lapping, polishing or buffing. Such abrasive products typically are in the form of an abrasive tool equipped with an abrasive face carrying abrasive particles used to abrasively remove material from a surface being abrasively treated when the abrasive face of the tool is engaged with the surface and the tool is moved along the surface. The surface being abrasively treated can be that of a floor, ceiling, countertop, slab, workpiece, painted surface, surface to be painted, a workpiece, a component, part or other object which abrasive removal of material is sought to be performed such as to cut the surface, shape the surface, clean the surface, remove a layer of the surface, lap the surface, hone the surface, polish the surface and/or buff the surface.

In abrasive grinding and cutting applications, bonded abrasive particles of a grinding or cutting tool, such as a grinding wheel or cutting disc, cut into, plow through and/or rub against the surface engaged by the tool to abrasively remove a considerable amount of material from the surface during relative movement therebetween. In abrasive finishing applications, relatively fine abrasive particles are disposed between the surface and an abrasive finishing tool, such as an abrasive polishing or buffing tool, which engages the surface to remove a lesser amount of material on or from the surface during relative movement therebetween in a manner that changes, typically smooths, the finish of the surface.

Polishing and buffing surface finishing treatments, such as those performed by hand or with the use of commonly available abrasive polishing or buffing tools, such as rotary and orbital polishers, belt and vibratory buffers, rotary and orbital buffers, and floor polishers and buffers, are also commonly used in various industrial, commercial, and household applications. Abrasive products are commonly used in such surface finishing treatment applications to polish or buff a surface being treated or finished that is a floor, countertop, panel, slab, sheet, or another surface that typically is generally flat or planar.

In one type of common surface finishing application used to impart a relatively smooth fine finish to the surface, the tool is a polishing or buffing tool that utilizes a disposable or replaceable polishing or buffing article, typically in the form of a buff, e.g., buffing wheel, pad or the like, made from layers of a fibrous fabric material which are stacked or fastened together and rotated, oscillated, orbited, reciprocated or the like to cause abrasive particles disposed between the buffing article and surface being finished to buff the surface. In the past, the abrasive particles used in buffing applications were entrained in a liquid, gel or paste of a polishing or buffing compound that was applied onto the surface being finished and/or the buffing article itself before buffing or polishing the surface using the buffing article. In buffing the surface, abrasive articles from the compound become pressed into the buffing article, which in turn causes the rotating and/or oscillating buffing article to urge the abrasive particles against the surface being finished thereby polishing or buffing the surface during relative movement therebetween.

Where surface finishing treatments are performed using polishing and/or buffing tools, the abrasive particles used are especially formulated to effect surface characteristics, such as texture, uniformity, smoothness and shine, in a desired manner. The abrasive particles are commonly made of aluminum oxide, silicon carbide, cemented carbide or a ceramic material, cubic boron nitride and/or diamond, whose size, shape and other characteristics are formulated, depending upon the type of abrasive material removal or surface finishing process being carried out, the type of tool being used, the nature of the surface being treated, as well as other factors. The abrasive particles are commonly pre-applied either to the surface being treated or the buffing article before treating the surface to buff or polish the surface.

Many polishing and buffing tools used to carry out surface finishing treatments use buffing articles configured for use with a buffing or polishing compound containing such abrasive particles that must be applied beforehand before polishing or buffing the surface is actually performed.

Users favor abrasive products or tools employing buffing articles that remove material and/or debris from the surface being abrasively treated relatively quickly and efficiently, while still being able to provide a desired finish or quality to the finish of the abrasively treated surface. Unfortunately, the rate or depth of debris and material removal and the quality of resultant finish of the surface being abrasively treated are often inversely related. That is, while abrasive tools that use finer grain abrasive particles typically produce smoother surfaces, such tools also commonly have lower material or debris removal rates such that abrasive tools that produce finer surface finishes often have significantly lower rates of debris or material removal. As a result, some compromise is nearly always involved in the choice of the abrasive tool, the abrasive particles used, and the material removal or surface finishing process employed. Accordingly, to achieve desired product throughput rates and surface quality, attention must be provided to the relative quality of the abrasive product and the effects associated with implementation of the same.

Other considerations also play a role in making these choices. The durability of a particular abrasive article, e.g., buff or buffing pad, used by a buffing or polishing tool can be impacted by the type of surface being abrasively treated, which can in turn impact the rate the surface is abrasively treated. Abrasive articles that excessively wear or more rapidly lose abrasive particles, e.g., lose grain, not only typically exhibit a lower material removal or surface treatment rate, but can also undesirably cause surface defects.

Rapid wear of the abrasive tool can relatively quickly reduce surface treatment rates and effectiveness, resulting in the need to more frequently change or replace the abrasive article, e.g., buff or buffing pad, thereby undesirably increasing treatment time and costs. Where not changed quickly enough, the performance of the abrasive article can become so degraded that the abrasive article can itself cause unwanted surface defects, which can require the need to perform additional surface treatment steps, e.g., additional polishing or buffing steps, to remedy. All these things can undesirably increase the time and cost required.

The use of a polishing or buffing compound carries with it its own set of considerations which must also be considered for the type of surface finishing treatment, e.g., buffing or polishing, application being carried out. While initial application of such a compound is a step that increases surface treatment time and cost, additional compound must be periodically reapplied as the compound is consumed during polishing or buffing of the surface further increasing surface finishing time and cost. Where compound is not uniformly applied or the abrasive particles in the compound not uniformly dispersed, the rate and effectiveness of polishing or buffing of the surface being treated can undesirably vary requiring additional compound and surface treatment time even further increasing costs.

Other factors come into play concerning the use of an abrasive compound. For instance, where the chosen polishing or buffing compound is less than optimal for the type of surface being polished or buffed, surface treatment rates can not only be undesirably reduced, but the resultant surface finish produced may be unsatisfactory requiring costly additional surface treatment to be performed. Even worse, where the chosen compound is less than ideal for the surface being treated, it may cause the polishing or buffing tool to undesirably mar, gouge, burnish, blemish, damage or otherwise corrupt the surface being treated. Because of the complications that can result in failing to choose the right compound for the particular polishing or buffing application at hand, there is a need for a polishing or buffing article that is usable without having to separately apply polishing or buffing compound during polishing or buffing of the surface being treated.

Having recognized such a need, others have attempted to provide abrasive polishing or buffing articles with a surface-engaging polishing or buffing substrate containing abrasive particles ordinarily found in polishing or buffing compound in order to seek to eliminate the need to use such compound during polishing or buffing surface treatment. However, such "compoundless" polishing and buffing articles are not without their respective drawbacks. While several considerations must be addressed to provide a compoundless polishing or buffing tool that provides the desired wear resistance, operation, and useable life to satisfy the additional cost of these abrasive articles, it has heretofore proven to be a significant challenge in suitably addressing them. For instance, it has proven to be an unmet challenge to produce a polishing or buffing article with a substrate having abrasive particles of a generally uniform size that are uniformly distributed throughout the substrate. Where the polishing or buffing substrate contains abrasive particles of less than optimal size or particle size distribution, polishing or buffing performance can be unsuitable. Where the abrasive particles are not uniformly distributed, excessive wear of the polishing or buffing article not only can result, but it can also result in non-uniform polishing or buffing of the surface. Not only can this undesirably increase costs and surface treatment time, including by reducing polishing or buffing article life, but marring, gouging, burnishing, blemishing, or other damage to the surface being polished or buffed can undesirably occur.

Still further, the substrate material must be able to withstand the chemical and physical introduction and adherence of the abrasive material to the substrate and must also be constructed to mitigate degradation of the substrate material itself during use of the buffing or polishing article. Known buffing and polishing articles that include self-supported abrasive materials have had only limited success in concurrently satisfying the various advantages disclosed above.

While buffing articles which require compound to be applied before polishing or buffing is carried out are very much still in common use, attempts have more recently been made to eliminate the need for a compound. While such attempts have been made, they are heretofore believed to have been less than successful.

Accordingly, there is a need of a buffing or polishing article, and method of forming the same, that exhibits a desired degree of uniformity of the abrasive particulate size and distribution, secures the abrasive a substrate in a manner that improves the longevity associated with use of the buffing or polishing article, and includes a substrate that is configured to withstand the process associated with adhesion of the abrasive to the substrate and which resists degradation or failure of the substrate during use

SUMMARY

In a preferred embodiment, the present invention is directed to (a) a method of making a buffing article that is a compoundless buff used to abrasively treat or finish a surface, such as a floor, a workpiece, such as a metal or plastic workpiece, a three-dimensionally shaped object, such as a casting, machined component, or molded plastic component, or the like, without the use of any separately applied buffing or polishing compound, (b) an abrasive-containing flowable aqueous compoundless buffing article coating solution of the method that is used to coat cloth or fabric, preferably a nonwoven cloth or nonwoven fabric, used to make the buffing article that is a compoundless buff used to abrasively treat or finish a surface, a workpiece, a three-dimensionally shaped object, or the like without the use of any separately applied buffing or polishing compound, and (c) a buffing article that is a compoundless buff having abrasive particles adhered by a binder to the cloth, preferably nonwoven cloth, of the buff, and which also has a lubricant impregnated in the cloth, preferably nonwoven cloth, of the buff enabling the compoundless buff to be used to abrasively treat or finish a surface, a workpiece, a three-dimensionally shaped object, or the like without the use of any separately applied buffing or polishing compound. Such a flowable aqueous compoundless buffing article coating solution and method of the invention produce a compoundless buff in accordance with the present invention that has relatively small abrasive particles impregnated in and fixed to the cloth or fabric, preferably nonwoven cloth or nonwoven fabric, used to form the compoundless buff enabling the compoundless buff of the invention to abrasively treat or finish a surface, workpiece, object or the like without the use or application of a buffing or polishing compound separately applied during abrasive treatment or finishing using the compoundless buff.

In carrying out a preferred implementation of the method of making a compoundless buff in accordance with the present invention, an abrasive-containing flowable aqueous compoundless buffing article coating solution of the invention is made that has abrasive particles, a binder, and a lubricant is applied onto nonwoven cloth used to form a buffing article that is a compoundless buff of the invention used to abrasively treat or finish a surface, workpiece, object or the like without applying any buffing or polishing compound to the surface, workpiece, object or the like being treated or finished with the buff. A preferred abrasive-containing coating solution is aqueous and contains relatively small particles of an abrasive, preferably aluminum oxide particles, e.g., calcined aluminum powder, and/or chromium oxide particles, e.g., chromium oxide powder, which are de-agglomerated and dispersed by an added surfactant. The abrasive-containing coating solution also includes a binder, preferably a binder emulsion composed of an acrylic, and a lubricant, preferably composed of polyethylene, which forms a relatively hard abrasive-containing coating when the coating solution is applied to the nonwoven cloth of the buffing article producing a compoundless buff of the invention where the cured relatively hard coating has interspersed regions, e.g., interspersed micelles, of (i) lubricant, and (ii) binder and abrasive impregnated or embedded therein.

A compoundless buff of the present invention is formed of a nonwoven cloth having a relatively hard coating disposed at or along a polishing or buffing working face of the buff that is composed of (i) binder fixing abrasive particles to fibers of the cloth of the buff that integrally imparts the ability to abrasively treat and finish surfaces, workpieces, objects and the like without use of any buffing or polishing compound, and (ii) lubricant that reduces friction where the working face contacts such surfaces, workpieces, objects and the like being abrasively treated or finished without use of any buffing or polishing compound. A preferred nonwoven cloth is a nonwoven needle-punched viscose cloth, such as a viscose rayon, which preferably has a weight ranging from about 3.3 ounces per square yard (osY) and about 3.9 ounces per square yard (osY) with a weight variation of no greater than 10% and preferably no greater than about 5%.

In one preferred compoundless buff, the lubricant of the abrasive-containing coating is a relatively hard lubricating material, such as a relatively hard polyethylene, preferably a high-density polyethylene, which forms at least a portion of the relatively hard coating on the working face of the buff that reduces friction between the buff and surface being treated with the buff because of the reduced relatively low coefficient of friction provided by the lubricant. In one such preferred compoundless buff, the relatively hard lubricating material, such as relatively hard polyethylene, preferably high-density polyethylene, also forms a lubricating layer at or along the area of contact between the buff and the surface being treated with the buff. Such a compoundless buff of the present invention with such an abrasive-containing coating having such a lubricant interspersed therein provides dual-mode friction reduction where the lubricant (i) has a relatively high hardness and durability that reduces the coefficient of friction between the buff working face and the surface being treated, and (ii) also forms a sacrificial lubricating layer along at least a portion of the buff working face during abrasive finishing contact with the surface being treated with the buff.

An abrasive particle containing flowable aqueous compoundless buffing article coating solution formulated in accordance with the present invention contains at least (i) a buffering agent or pH regulator to maintain flowability and prevent gelling, (ii) a surfactant to disperse relatively small abrasive particles within the coating solution, (iii) relatively small particles of an abrasive, such as particles of aluminum oxide and/or chromium oxide, (iv) a lubricant, preferably in the form of a lubricant emulsion, (v) a suspension agent, preferably a gum that more preferably is xanthan gum to help keep the abrasive particles suspended after the addition of the lubricant or lubricant emulsion, and (vi) a binder, preferably in the form of a binder emulsion that more preferably is in the form of an acrylic binder emulsion. Such a flowable aqueous compoundless buffing article coating solution preferably also contains a pH regulator to help maintain flowability and prevent gelling and can also contain a foaming agent to facilitate application of the coating solution using a foam applicator onto the cloth or fabric, preferably nonwoven cloth or fabric, of a buffing article that is a compoundless buff of the present invention. Where a foam applicator is used to coat the cloth or fabric, preferably nonwoven cloth or nonwoven fabric, of the buffing article in making a compoundless buff the invention, the coating solution contains a foaming agent to facilitate foaming application of the coating solution. Where a different type of applicator is employed, such as spray applicators, e.g., using nozzles, orifices or the like, the coating solution contains no foaming agent.

In carrying out a method of making a compoundless buff in accordance with the present invention, a preferred method of making is first carried out to produce such a water-based coating solution that is applied to nonwoven cloth of a buffing article to form a water-based abrasive-containing coating thereon producing such a compoundless buff of the invention. In implementing the coating solution making method, a predetermined amount of water is measured or provided that is an amount sufficient to provide or form an aqueous base of the coating solution in which all the preferred constituents needed to make the coating solution are added in subsequent steps of the method as described in more detail below. A predetermined amount of water is measured out suitable for making the coating solution, which is a flowable solution that preferably is a foaming, foamable, or otherwise sprayable solution, which can be applied via applicators, e.g., foam applicators and/or spray applicators, onto the nonwoven cloth of the buffing article to coat it to form the compoundless buff.

In a preferred method implementation, in a first method step that is a pH regulator adding step or buffering agent adding step, a pH regulator that preferably is a buffering agent that more preferably is sodium borate, sodium tetraborate, or disodium tetraborate, e.g., borax, is added to the predetermined amount of water. The borax dissolves in the water and acts as a pH adjuster or buffering agent to maintain proper pH of the resultant final coating solution produced when all constituents are added so the coating solution stays flowable. Adding borax as a pH regulator and/or buffering agent maintains the pH of the coating solution above a desired pH of 8.0, thereby maintaining flowability of the coating solution by preventing the viscosity of the coating solution from decreasing and gelling when applied onto the nonwoven cloth in making the compoundless buff.

In carrying out this method step, an amount of the pH regulator that preferably is a buffering agent that more preferably is borax is added to the water forming an intermediate solution that is sufficient to maintain a proper pH of the final flowable aqueous compoundless buffing article coating solution that maintains flowability and prevents gelling when all the constituents that makeup the coating solution are added. A sufficient amount of the pH regulator that preferably is a buffering agent that more preferably is borax is added to prevent the coating solution from becoming acidic. In one preferred implementation of a method of making a coating solution, a pH regulator that preferably is borax, which preferably also is a buffering agent is added to the solution to keep its pH at a level of at least 8.0 to maintain coating solution flowability and prevent gelling.

In a preferred method implementation and solution, a sufficient amount of the pH regulator that preferably is a buffering agent that more preferably is borax is added to the intermediate solution to keep the solution within a pH range of between 8.1 and 9.1 and more preferably between 8.5 and 9.5. In one such preferred method implementation and solution, a sufficient amount of the pH regulator that preferably is a buffering agent that more preferably is borax is added to the solution to try to maintain the solution at a target pH of about 8.7±0.2. In another such preferred method implementation and solution, a sufficient amount of the pH regulator that preferably is a buffering agent that more preferably is borax is added to the solution to try to maintain the solution at a target pH of about 9.1±0.2.

In a second method step that is a surfactant adding step performed before abrasive particles are added, a surfactant that preferably is a nonionic surfactant is added to the solution, with the surfactant preferably also being a wetting agent added in an amount sufficient to de-agglomerate and/or help disperse the abrasive particles subsequently added in an abrasive adding step. In addition to dispersing the abrasive particles within the solution when the abrasive particles are added, the surfactant can and preferably does help keep the abrasive particles suspended within the solution. In a preferred method implementation and coating solution, one or more of a polyethylene glycol octylphenyl ether, an alkylphenol ethoxylate, an octylphenol ethoxylate, or an octylphenol polyethoxylate are suitable nonionic surfactants that also are wetting agents that can be added in an amount sufficient to de-agglomerate and disperse abrasive particles subsequently added in an abrasive particle adding step.

In a preferred method implementation and coating solution, polyethylene glycol octylphenyl ether or alkylphenol ethoxylate is added as a surfactant during the surfactant adding step with the polyethylene glycol octylphenyl ether or alkylphenol ethoxylate also being a wetting agent that wets the abrasive particles when they are added. In another preferred method implementation and coating solution, polyethylene glycol octylphenyl ether or octylphenol ethoxylate is added as a wetting agent surfactant. In still another preferred embodiment, polyethylene glycol octylphenyl ether or octylphenol polyethoxylate is added during the surfactant adding step.

Another preferred nonionic surfactant well suited for use in a preferred implementation of a method of making such a coating solution and compoundless buff that also produces a coating solution in accordance with the present invention is a linear alcohol ethoxylate surfactant. Where a linear alcohol ethoxylate surfactant is added, it is added in an amount sufficient to de-agglomerate and help disperse or substantially disperse the abrasive particles added during the subsequent abrasive particle adding step. Nonionic surfactants well suited for use in deagglomerating and dispersing the abrasive particles subsequently added include surfactants having a linear hydrocarbon tail, e.g., linear hydrocarbon tail surfactants, and/or a branched hydrocarbon tail, e.g., branched hydrocarbon tail surfactants, which preferably also are wetting agents.

Such nonionic surfactants not only de-agglomerate and help disperse abrasive particles added during the subsequent abrasive particle adding step, but they also help de-agglomerate and disperse pigment where pigment also is subsequently added to the solution. Where pigment is added, the amount of surfactant added is sufficient to not only de-agglomerate the abrasive particles added to the solution, but also to de-agglomerate and disperse pigment added to the solution.

In a third method step that is an abrasive adding step performed after surfactant is added during the surfactant adding step, abrasive in the form of relatively small abrasive particles is added to the solution where the surfactant de-agglomerates the abrasive particles and helps disperse them within the solution. In a preferred method implementation and coating solution, abrasive particles in the form of aluminum oxide, preferably calcined alumina or calcined aluminum oxide, are added in an amount not only dependent on the amount of surfactant added to the solution but also that achieves a desired abrasive particle density on the working face of the compoundless buff when subsequently coated with the finished coating solution.

The size of the particles of the aluminum oxide, preferably calcined aluminum oxide, ranges between 0.5 and 45 microns and has a median particle size ranging between about 2 microns and 5 microns. The calcined aluminum oxide abrasive particles have a pH of between 8 and 10, with the calcined aluminum particles having a preferred pH of between 9.3 and 9.4. The calcined aluminum oxide is fired to a high temperature and then milled to form abrasive calcined aluminum oxide particles having the aforementioned desired specifications or ranges.

Where a compoundless buff that provides a finer surface finish is desired, a plurality of different types of abrasives can be added during the abrasive adding step, with one type of abrasive particles added being aluminum oxide particles, preferably calcined aluminum particles, and another type of abrasive particles added preferably being chromium oxide particles. Where chromium oxide abrasive particles are added to the solution during the abrasive adding step, the chromium oxide particles have a size ranging between 0.1 micron and 10 microns and preferably have a median particle size of no greater than 1 micron. In one preferred method implementation and coating solution, chromium oxide particles added during the abrasive adding step have a median particle size less than 1 micron.

The amount of abrasive particles, such as particles of aluminum oxide, calcined aluminum oxide, and/or chromium oxide, added to the solution during the abrasive adding step also is enough to produce an abrasive-containing flowable aqueous compoundless buffing article coating solution containing between 35% and 60% abrasive particles by weight of the solution when the abrasive particles are added. The amount of abrasive particles, such as particles of aluminum oxide, calcined aluminum oxide, and/or chromium oxide, added to the solution during the abrasive adding step also is enough to produce such a coating solution that forms a hardened coating when applied to the working face of the compoundless buff containing at least 55% abrasive particles by dry weight of the coating. In one preferred method implementation and compoundless buff, the finished coating solution has a sufficient amount of the abrasive particles to produce a dried hard, e.g., cured, coating, on the buff containing enough abrasive particles in the coating to make up between 60% and 70% of the dry weight of the coating on the buff. In one such preferred method implementation and compoundless buff, the coating solution has a sufficient amount of the abrasive particles to produce a dried hard, e.g., cured, coating where the abrasive particles make up about 66%±2% of the dry weight of the coating.

In a preferred method of testing a finished or completed compoundless buff of the present invention to determine whether the dried and hard, e.g., cured, coating on the buff contains enough abrasive particles to suitably perform in buffing, polishing and other surface finishing applications for which the buff is well suited, a five gram or ten gram sample or specimen of the buff is taken and burned to incinerate or volatize its organic components leaving behind residue containing the abrasive particles originally in the coating. The residue is weighed to determine whether its mass or weight falls within the desired abrasive particle range of at least 50% of dry coating weight, preferably at least 60% of dry coating weight, more preferably between 60% and 70% of dry coating weight, and even more preferably about 66%±2% of dry coating weight.

The measured stiffness of the abrasive particle containing coated nonwoven cloth of the compoundless buff should have a target stiffness of about 17.00, where its stiffness is measured in accordance with ASTM D1388 or D4032 and which is acceptable so long as the measured stiffness falls within 13.50 and 20.00. The abrasive content of a 5 gram or 10-gram compoundless buff sample of the abrasive particle containing coated nonwoven cloth of the compoundless buff should be about 35% of the weight of the original sample and fall between 30% and 40% of the weight of the original sample after all of the organic material of the compoundless buff sample is burned or otherwise vaporized away.

If desired, pigment, such as green pigment, e.g., chromium oxide, can also be added during the abrasive adding step, before the abrasive adding step but after the surfactant adding step, or after the abrasive adding step. Where pigment is added, the surfactant also helps de-agglomerate and disperse pigment within the solution. Where pigment is added, it is added in an amount based on the amount of abrasive particles and surfactant added to the solution so as to ensure the surfactant not only de-agglomerates and disperses the abrasive particles within the solution but that the surfactant also de-agglomerates and disperses the pigment within the solution. An advantage of adding chromium oxide as a pigment is that it also serves as an abrasive whose particle size is smaller than the aluminum oxide abrasive particles, e.g., calcined alumina particles, which helps impart the surface, workpiece, object or the like treated with the compoundless buff with a finer surface finish than a compoundless buff made only with aluminum oxide, e.g. calcined alumina, abrasive particles.

In a fourth method step that is a lubricant emulsion adding step performed after surfactant and abrasive particles have been added to the solution, a lubricant emulsion that is a polymer lubricant emulsion that more preferably is a nonionic polymer lubricant emulsion composed of a relatively hard lubricating material, preferably a polyethylene resin, more preferably a relatively hard polyethylene, even more preferably a high-density lubricating material, and even more preferably a high-density polyethylene, is added to the solution to impart lubricity to the compoundless buff when the buff is coated with the finished coating solution. Such a lubricant emulsion is blended with the solution using a conventional mixer or blender as known in the art until homogenous with the solution, such that the solution containing the emulsion is smooth and fluid. Use of a nonionic lubricant emulsion preferably composed of polyethylene advantageously helps prevent smoking during curing after being applied to the nonwoven cloth of the compoundless buff. This is because such nonionic emulsions have a higher flashpoint and distillation range than fatty acid soap type emulsions. In addition, such a nonionic lubricant emulsion is preferred over a fatty acid soap type emulsion because a fatty acid soap type emulsion is more reactive with the calcined aluminum abrasive particles than are nonionic emulsions.

Use of a relatively hard polyethylene, preferably a high-density polyethylene, in such a polymer lubricant emulsion advantageously imparts lubricity to the nonwoven cloth at the working face of the compoundless buff that contacts the surface, workpiece, object or the like being abrasively finished or treated. As a result, a lubricant layer or lubricating layer advantageously forms between the working face of the compoundless buff and the surface being treated with the buff. The addition of high-density polyethylene as a lubricant emulsion also helps tie abrasive particles into fibers of the nonwoven cloth of the compoundless buff after the coating solution is applied thereon and cured. Such a high-density polyethylene lubricating emulsion also helps retain abrasive particles at the working face where there is contact between the compoundless buff and the surface being treated therewith by forming a gum, such as a lubricating gum, which helps prevent abrasive particles that have broken free of the binder and nonwoven cloth from migrating outwardly of the working face.

It is critical that the surfactant and abrasive particles be added to the solution before the lubricant emulsion is added so the abrasive particles are not only dispersed within the solution but also wetted by the surfactant, minimizing and preferably substantially completely preventing any chemical reaction between the abrasive particles and the lubricant emulsion from occurring. In a preferred method implementation where the abrasive particles include aluminum oxide particles, preferably calcined alumina particles, surfactant must be added before the calcined aluminum particles are added in order for the surfactant to wet the calcined aluminum particles, de-agglomerate them, and disperse them within the solution before polyethylene resin lubricant is added to prevent the calcined aluminum particles from reacting with the polyethylene.

After the lubricant emulsion adding step is performed, a suspension agent adding step is performed where a suspension agent that is a gum, preferably xanthan gum, is added to help keep the surfactant-dispersed abrasive particles suspended in the solution to which the polyethylene resin lubricant emulsion has been added. In a preferred method implementation, the suspension agent adding step is performed as the very next step after the lubricant emulsion adding step is performed. In a preferred method implementation, the suspension agent used, preferably xanthan gum, also is a stabilizer, preferably an emulsion stabilizer, which helps prevent separation of any component of any emulsion, including the lubricant emulsion, e.g., polyethylene, added to the solution.

After performing the suspension agent adding step, the solution is not finished but is in the form of a slurry which can be stored or shipped to another location where the rest of the constituents are added to produce the finished flowable aqueous compoundless buffing article coating solution. Where the solution is going to be stored or shipped as such a slurry, adding the suspension agent is critical the keep the abrasive particles suspended while the solution or slurry is being stored and/or shipped until the rest of the constituents can be subsequently added to form the finished coating solution.

Where all the rest of the constituents needed to produce a finished abrasive particle containing flowable aqueous compoundless buffing article coating solution in accordance with the present invention are added at the same time at the same location, it is contemplated that the aforementioned suspension agent may not be needed or used. In at least one preferred method implementation where all the constituents of the finished coating solution are added together, e.g., blended or mixed together, at the same time and at the same location, no suspension agent is used.

In carrying out the rest of the method step to add the rest of the constituents to produce the finished coating solution, a binder adding step is carried out where a binder emulsion composed of an acrylic binder, e.g., acrylic binder resin, which preferably is a crosslinking acrylic binder, e.g., a crosslinking acrylic binder resin, which more preferably is a self-crosslinking acrylic binder, e.g., a self-crosslinking acrylic binder resin, is added in an amount sufficient to bind the abrasive particles dispersed or suspended in the finished coating solution to fibers of the nonwoven cloth used to make the compoundless buff when coated therewith. In a preferred method implementation and coating solution formulation, between 12% and 24% acrylic binder is added by finished coating solution weight. In one such formulation, the finished coating solution contains at least 15% acrylic binder by coating solution weight. In another such formulation, the finished coating solution contains at least 18% acrylic binder by coating solution weight.

Such a binder preferably is a binder emulsion that more preferably is composed of acrylic, preferably an acrylic resin, e.g. acrylic resin binder, which more preferably is a crosslinking or crosslinked acrylic or crosslinking or crosslinked acrylic resin, e.g., crosslinking or crosslinked acrylic resin binder, which even more preferably is a self-crosslinking or self-crosslinked acrylic resin, e.g., self-crosslinking or self-crosslinked acrylic resin binder, which advantageously binds the abrasive particles to fibers of the nonwoven cloth of the compoundless buff while remaining flexible and durable. By remaining flexible and durable, such an acrylic binder possesses good toughness, advantageously helping to keep abrasive particles bound to the nonwoven cloth of the compoundless buff despite abrasive particles experiencing numerous impacts and shocks during abrasive contact with the surface being treated with the compoundless buff. In other words, use of such an acrylic binder that possesses such flexibility and durability advantageously better absorbs impacts and shocks encountered by abrasive particles bonded by such binder to fibers of the non-woven cloth of the compoundless buff thereby minimizing and helping prevent abrasive particles from breaking off and migrating free of the buff, thereby advantageously increasing the useful abrasive life of the compoundless buff.

Use of a self-crosslinking acrylic binder in the binder emulsion is preferred because it produces a harder, denser coating after application of the coating solution onto the nonwoven cloth and curing. Use of a self-crosslinking acrylic binder is further preferred because it more tightly bonds the abrasive particles to fibers of the nonwoven cloth of the compoundless buff better anchoring the abrasive particles to the working face of the buff. In addition, use of a self-crosslinking acrylic binder advantageously produces an abrasive-containing coating on and in the working face of the nonwoven cloth of the compoundless buff that has superior chemical resistance helping produce a more stable and durable abrasive-containing coating.

As a result of the use of such a binder emulsion composed of relatively flexible, tough and durable acrylic binder that binds abrasive particles to the nonwoven cloth of the buff, a compoundless buff advantageously is produced having wear characteristics similar to or substantially same as a conventional buff that requires use of a separately applied buffing or polishing compound. In other words, a compoundless buff of the present invention made using a coating solution containing an acrylic binder, preferably a crosslinking acrylic binder, more preferably a self-crosslinking acrylic binder, which binds the abrasive particles to the nonwoven cloth of the compoundless buff produces a compoundless buff of the invention that wears at least long as a conventional buff.

A viscosity modifier preferably is added to the solution in a solution viscosity modifying step that preferably is a thickener added in an amount sufficient to maintain a proper viscosity of the finished coating solution that makes it flowable and easily applied onto the working face of the nonwoven cloth that forms the compoundless buff when coated with coating solution. In a preferred method implementation and solution, a cellulosic suspension agent, preferably a cellulose or gum, more preferably carboxymethyl cellulose or cellulose gum, is added as a viscosity modifier that is a thickening agent in an amount sufficient to maintain a readily flowable viscosity of the coating solution that not only allows it to be easily applied but which also maintains a high enough viscosity that facilitates relatively uniform application of the coating solution onto the porous and fibrous nonwoven cloth of the compoundless buff.

In a preferred coating solution formulation, carboxymethyl cellulose or cellulose gum not only is a viscosity modifier that is a thickener that decreases the viscosity of the coating solution, both of these constituents are an emulsion stabilizer that stabilizes one or both the lubricant emulsion and/or the binder emulsion in the finished coating solution. The carboxymethyl cellulose or cellulose gum function as an emulsion stabilizer by thickening the coating solution thereby thickening the lubricant emulsion and binder emulsion in the coating solution helping maintain a substantially homogenous distributions of the emulsions within the coating solution.

In a preferred method implementation and coating solution formulation, at least 0.1%, preferably at least 0.2%, and more preferably at least 0.3% carboxymethyl cellulose or cellulose gum is added by weight of the solution. In one such method implementation and formulation, at least 0.1%, preferably at least 0.2%, and more preferably at least 0.3% carboxymethyl cellulose or cellulose gum is added by weight of the aforementioned slurry. In another such method implementation and formulation, at least 0.1%, preferably at least 0.2%, and more preferably at least 0.3% carboxymethyl cellulose or cellulose gum is added by weight of the finished coating solution. In still another preferred coating solution embodiment, between about 0.2% and 0.5% carboxymethyl cellulose is added by weight of the slurry. In yet another preferred coating solution embodiment, between about 0.2% and 0.5% carboxymethyl cellulose is added by weight of the finished coating solution.

A method of making an abrasive-containing coating solution in accordance with the present invention includes at least one additional surfactant adding step where one or more surfactants as known in the art are added to the solution after the binder emulsion has been added. Surfactant is added in an amount sufficient to facilitate dispersion and/or suspension of (i) the polyethylene lubricant, e.g., polyethylene resin, of the lubricant emulsion, and (ii) the acrylic binder, e.g., self-crosslinking acrylic resin, of the binder emulsion in the finished coating solution.

The surfactant is added after the lubricant emulsion and binder emulsion have been added to the solution in order to increase the wetting ability or surface tension of the finished coating solution applied onto the porous fibrous nonwoven cloth of the compoundless buff. As a result of possessing increased wetting ability or increased surface tension, the finished coating solution wicks into pores in the fibrous nonwoven cloth penetrating the coating solution deeper into the working face of the nonwoven cloth of the compoundless buff. This produces a compoundless buff of the present invention having an abrasive-containing coating that extends deeper into the nonwoven cloth thereby advantageously distributing abrasive particles carried by the coating solution more deeply within the working face of the compoundless buff. This results in abrasive particles, binder, and lubricant of the coating solution being more uniformly and more deeply distributed on, around and within the working or working face of the compoundless buff producing a compoundless buff of the present invention that lasts longer.

In a preferred method implementation and coating solution formulation, surfactant is added in an amount of at least 1.5%, preferably at least 2%, and more preferably at least 3% by weight of the coating solution. In one preferred coating solution formulation, between 2% and 7% surfactant is added to the coating solution by coating solution weight.

Where the finished coating solution is applied using a foam applicator, a foaming agent also is added to the solution in a foaming agent adding step. Use of such a foaming agent facilitates foaming of the finished coating solution when applied by a foam applicator onto the nonwoven cloth of the compoundless buff. A preferred foaming agent is aqua ammonia or ammonium hydroxide as it also functions as an adhesion promoter that enhances adhesion of the coating solution to the nonwoven fiber onto which the coating solution is applied with a foam applicator. In one preferred coating solution, aqua ammonia or ammonium hydroxide not only functions as a foaming agent but also as an adhesion promotor that facilitates or enhances adhesion of one or more of the abrasive particles, binder and/or lubricant to fibers of the nonwoven cloth of the compoundless buff. In another preferred coating solution, aqua ammonia or ammonium hydroxide not only functions as a foaming agent but also as an adhesion promotor that facilitates or enhances adhesion of a plurality of the abrasive particles, binder and/or lubricant to fibers of the nonwoven cloth of the compoundless buff. In yet another preferred coating solution, aqua ammonia or ammonium hydroxide not only functions as a foaming agent but also as an adhesion promotor that facilitates or enhances adhesion of each one of the abrasive particles, binder and/or lubricant to the nonwoven cloth of the compoundless buff.

Aqua ammonia is a preferred foaming agent because it preferably is added right before the coating solution is applied onto the nonwoven cloth of the compoundless buff as it also functions as an pH regulator to help control the pH of the coating solution. In a preferred method implementation and coating solution formulation, the coating solution contains at least 0.75%, preferably at least 1%, and more preferably at least 1.2% aqua ammonia by weight of the finished coating solution. In one such preferred method implementation and coating solution formulation, the coating solution contains between 1% and 2% aqua ammonia by coating solution weight as this is a sufficient amount for the aqua ammonia to function as a foaming agent and at least one of a pH regulator, e.g., acidity regulator, dispersion agent, and adhesion promotor. In another such preferred method implementation and coating solution formulation, the coating solution contains between 1% and 2% aqua ammonia by coating solution weight as this is a sufficient amount for the aqua ammonia to function as a foaming agent and at least a plurality of a pH regulator, e.g., acidity regulator, dispersion agent, and adhesion promotor. In yet another such preferred method implementation and coating solution formulation, the coating solution contains between 1% and 2% aqua ammonia by coating solution weight as this is a sufficient amount for the aqua ammonia to function as a foaming agent, a pH regulator, e.g., acidity regulator, a dispersion agent, and an adhesion promotor in the coating solution applied onto nonwoven cloth to make the compoundless buff.

Where a foaming agent is used, a foam stabilizing agent of foam stabilizer as known in the art preferably also is added in a foam stabilizer adding step. The foam stabilizing agent is added to help control bubble formation or foaming in the emulsion(s) of the finished coating solution in a manner that promotes foaming application of the binder, abrasive particle, and lubricant containing onto the working face of nonwoven cloth of the compoundless buff in an even controlled manner. Foam stabilizing agent is added in in an amount of at least 1.5%, preferably at least 2%, and more preferably at least 2.5% by weight of the finished coating solution. In one preferred method implementation and coating solution formulation, foam stabilizing agent is added to the coating solution in an amount between 2% and 5% by weight of the finished coating solution.

Application of the finished coating solution onto the portion of the nonwoven cloth of the buff that forms the working face that comes in contact with the surface, workpiece, object or the like being abrasively treated or finished produces an abrasive-particle containing coating thereon that is also interspersed with friction-reducing lubricant. Such a coating solution preferably becomes impregnated into the nonwoven cloth during application onto the portion of the nonwoven cloth that forms the working face of the compoundless buff. This results in a coating being formed when the coating solution cures, e.g., dries, that is interspersed and embedded within pores and fibers of the nonwoven cloth that forms the working face thereby producing a compoundless buff in accordance with the present invention having (a) between 30% and 65% of an abrasive material, e.g., abrasive particles, preferably an oxide abrasive material, more preferably an aluminum oxide abrasive material, (b) between 0.25% and 7.5% surfactant, (c) between 2.5% and 10.0% of a lubricant, preferably a lubricating resin, more preferably a lubricating polymer resin, and even more preferably a polyethylene resin, (d) between 0.25% and 5% of a buffering agent, and (e) the remainder, preferably between 25% and 65%, being water.

In another preferred embodiment, an abrasive-containing flowable aqueous compoundless buffing article coating solution is applied onto the portion of nonwoven cloth of a buffing article that defines the working face, substantially uniformly covering the face and becoming impregnated within the face forming a binder, abrasive-particle, and lubricant containing relatively hard coating interspersed and embedded within pores and between fibers of the nonwoven cloth forming the working face producing a compoundless buff in accordance with the present invention having (a) between 32.5% and 62.5% of an abrasive material, e.g., abrasive particles, preferably an oxide abrasive material, more preferably an aluminum oxide abrasive material, (b) between 0.4% and 6.0% surfactant, (c) between 3% and 10% of a lubricant, preferably a lubricating resin, more preferably a lubricating polymer resin, and even more preferably a polyethylene resin, (d) between 0.4% and 2.5% of a buffering agent, and (e) the remainder, preferably between 30% and 60%, being water.

In a further preferred embodiment, an abrasive-containing flowable aqueous compoundless buffing article coating solution used to treat a buffing article of the present invention formed of a non-woven material, e.g., non-woven cloth or non-woven fabric, to impregnate it with the coating solution causing it to become embedded therein producing a compoundless buff in accordance with the present invention having (a) between 35% and 60% of an abrasive material, e.g., abrasive particles, preferably an oxide abrasive material, more preferably an aluminum oxide abrasive material, (b) between 0.5% and 5.0% surfactant, (c) between 4% and 9% of a lubricant, preferably a lubricating resin, more preferably a lubricating polymer resin, and even more preferably a polyethylene resin, (d) between 0.5% and 2% of a buffering agent, and (e) the remainder, preferably between 35% and 55%, being water. In one such preferred embodiment, the coating solution has (a) between 35% and 60% aluminum oxide abrasive material, (b) between 0.5% and 5.0% surfactant, (c) between 4% and 9% of a polyethylene resin, (d) between 0.5% and 2% of a buffering agent, and (e) the remainder, preferably between 35% and 55%, being water.

In yet another preferred embodiment, an abrasive-containing flowable aqueous compoundless buffing article coating solution used to treat a buffing article of the present invention formed of a non-woven material, e.g., non-woven cloth or non-woven fabric, to impregnate it with the coating solution embedding it therein producing a compoundless buff in accordance with the present invention having (a) between 30% and 60% of an abrasive material, e.g., abrasive particles, preferably an oxide abrasive material, more preferably a combination of a chromium oxide and aluminum oxide abrasive particles, (b) between 4% and 16% of at least one lubricant; (c) between 2.5% and 15% of a surfactant that preferably is an emulsifier that more preferably includes between 3% and 12.5% of triethanolamine oleate, and (d) the remainder, between 30% and 60%, being water by weight of the compoundless buffing article treatment solution. In one preferred embodiment, the lubricant is composed of a combination of one or more glycerides and a lubricating resin, more preferably a lubricating polymer resin, and even more preferably a polyethylene resin. In one such preferred embodiment, the coating solution has (i) between 1% and 5% of a glyceride that preferably is a fatty acid glyceride, and (ii) between 5% and 10% of a resin that preferably is a polymer resin that more preferably is a polyethylene resin, both of which can and preferably does provide a buffing lubricant to the compoundless buff or buffing article of the invention when treatment of the buff or buffing article is finished.

In another such preferred embodiment, an abrasive-containing flowable aqueous compoundless buffing article coating solution of the present invention has (a) between 32.5% and 55% of a first type of an abrasive material, e.g., abrasive particles, preferably an oxide abrasive material, more preferably an aluminum oxide abrasive, (b) between 2.5% and 10% of a second type of an abrasive material, e.g., abrasive particles, preferably an oxide abrasive material, more preferably a chromium oxide abrasive, (c) between 5% and 15% of at least one lubricant; (c) between 3% and 12.5% of a surfactant that preferably is an emulsifier that more preferably is triethanolamine oleate, and (d) the remainder, between 30% and 60%, being water by weight of the flowable aqueous compoundless buffing article treatment solution. The lubricant of one such preferred coating solution has (i) between 1.5% and 5% of fatty acid glyceride, and (ii) 3% and 10% of polyethylene resin. The lubricant of another such preferred coating solution has (i) between 2% and 3% of fatty acid glyceride, and (ii) 4% and 9% of polyethylene resin. In another such preferred embodiment, the coating solution has (a) between 35% and 50% of an aluminum oxide abrasive, e.g., aluminum abrasive particles, (b) between 4% and 8% of a chromium oxide abrasive, e.g., chromium oxide abrasive particles, (c) between 2% and 4% of a glyceride lubricant that preferably is a fatty acid glyceride, (d) between 4% and 9% of a lubricating polymer resin that preferably is a polyethylene resin, (e) between 4% and 10% of triethanolamine oleate, and (f) the remainder, between 35% and 55%, water by weight of the aqueous compoundless buffing article treatment solution.

In a preferred embodiment, a flowable aqueous buffing compound solution carrier that can be and preferably is an emulsion that is mixed with any one of the embodiments of the coating solution(s) or slurry/slurries disclosed above and/or elsewhere herein forming a coating solution that is used to treat the non-woven material, e.g., non-woven fabric or non-woven cloth, of a buffing article or buff that is then dried leaving behind a coating composed of binder, abrasive, and lubricant impregnated therein forming a compoundless buff of the present invention. In one such preferred embodiment, a flowable aqueous buffing compound solution carrier of the present invention that can be and preferably is an emulsion has (a) between 0.1% and 0.75% of a thickener that preferably is a cellulose thickener that more preferably is a carboxymethyl cellulose thickener, (b) between 0.5% and 4% of an acidity regulator that preferably is an ammonia alkyl-based acidity regulator that more preferably is aqua ammonia, (c) between 1% and 7.5% of one or more foam stabilizers, (d) between 1% and 10% of one or more surfactants, (e) between 10% and 30%, preferably between 10% and 25%, of a binder that preferably is an acrylic binder, (f) a green slurry as known in the art, and (g) the remainder, between 25% and 55%, preferably between 30% and 50%, being water. In another preferred embodiment, the flowable aqueous buffing compound solution carrier has (a) between 0.2% and 0.5% of a thickener that preferably is a cellulose thickener that more preferably is a carboxymethyl cellulose thickener, (b) between 0.75% and 3% of an acidity regulator that preferably is an ammonia alkyl-based acidity regulator that more preferably is aqua ammonia, (c) between 1.5% and 6% of one or more foam stabilizers, (d) between 1.5% and 7.5% of one or more surfactants, (e) between 10% and 25%, preferably between 12% and 24%, of a binder that preferably is an acrylic binder, (f) between 30% and 50%, preferably between 40% and 45%, and more preferably about 42%±1.5% of a green slurry as known in the art, and (g) the remainder, between 30% and 50%, preferably between 35% and 45%, being water. In a further preferred embodiment, the flowable aqueous buffing compound solution carrier has (a) between 0.2% and 0.5% of a thickener that preferably is a cellulose thickener that more preferably is a carboxymethyl cellulose thickener, (b) between 1% and 2% of an acidity regulator that preferably is an ammonia alkyl-based acidity regulator that more preferably is aqua ammonia, (c) between 2% and 5% of one or more foam stabilizers, (d) between 2% and 7% of one or more surfactants, (e) between 12% and 24% of a binder that preferably is an acrylic binder, (f) about 42%±1.5% of a green slurry such as is known in the art, and (g) the remainder, between 35% and 45%, being water.

Application and drying impregnates the portion of non-woven cloth of a buffing article that forms the buffing or polishing working face with binder, abrasive particles, and lubricant forming a relatively hard coating having regions or micelles of binder and abrasive particles interspersed with regions or micelles of lubricant forming a compoundless buff of the present invention that lubricates as it abrades and which is well suited for use in a wide variety of buffing, polishing, finishing, and abrasive material removal applications as compoundless buff is used without any application of any buffing or polishing compound.

DRAWING DESCRIPTION

Figure 2:
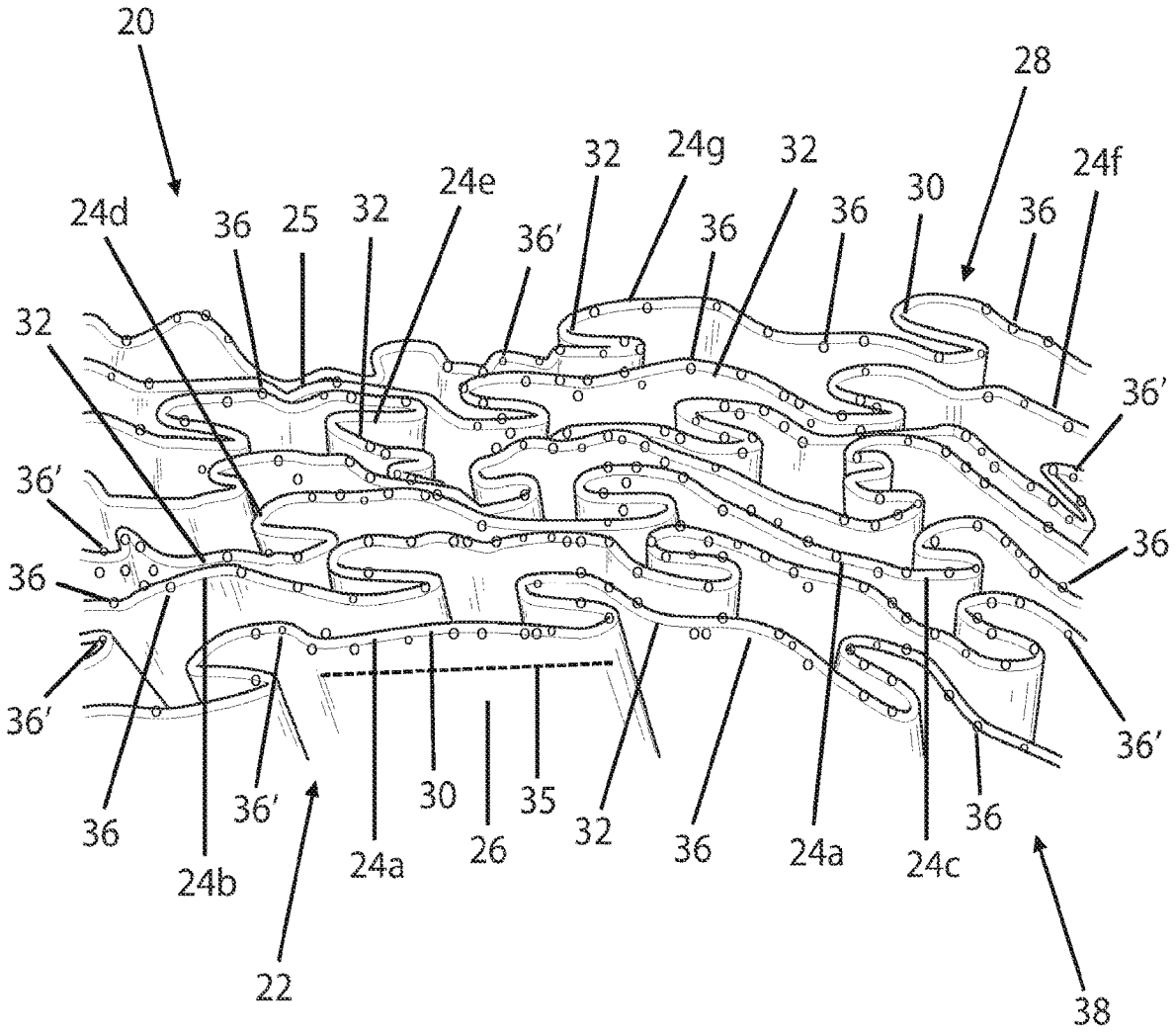
Figure 3:
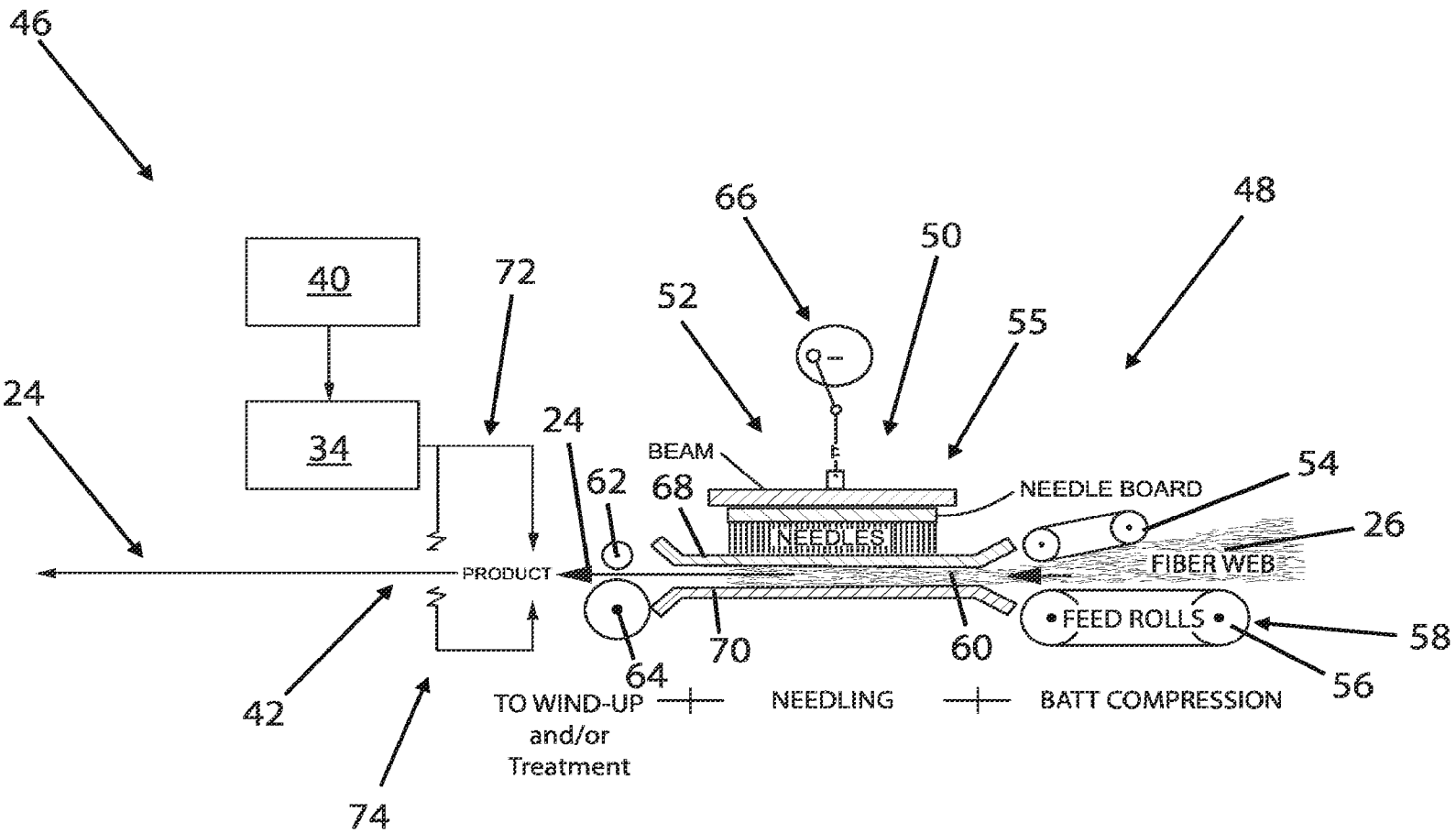

One or more preferred exemplary embodiments of the invention are illustrated in the accompanying drawings in which like reference numerals represent like parts throughout and in which:

FIG. 1 is an annular polishing or buffing article or buff constructed in accordance with the present invention that is of compoundless construction having one or more non-woven cloth or fabric layers impregnated with a polishing or buffing lubricant and abrasive coating that eliminates the need for use of polishing or buffing compound prior to and during polishing or buffing with the buffing article;

FIG. 2 is a partial perspective edge view of the compoundless buffing article of FIG. 1 showing in more detail a polishing or buffing lubricant and abrasives treated working face of a plurality of treated non-woven cloth or fabric layers of the buffing article that come into contact with the surface of a workpiece, floor, ceiling or other object being surface finished by polishing or buffing with the compoundless buffing article; and FIG. 3 is a schematic representation associated with an exemplary method of making a compoundless buffing article in accordance with the present invention.

Before explaining one or more embodiments of the invention in detail, it is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for the purpose of description and therefore should not be regarded as limiting.

DETAILED DESCRIPTION

FIGS. 1 and 2 illustrate part of an abrasive surface finishing product 20 removably carried by a power tool (not shown) which is or includes a buffing article 22 that is of compoundless construction and which preferably is in the form of a compoundless buff 23 of the present invention that is removable, replaceable, disposable, and which is used in abrasive treatment and surface finishing applications without separate application of any buffing or polishing compound. Compoundless buff 23 is a buffing article 22 formed of a fibrous material 26, preferably a nonwoven cloth or nonwoven fabric, to which a coating 27 is adhered that contains (i) abrasive particles 33 bonded to fibers of the fibrous material 26 of the buff 23 by a binder 29, and (ii) a lubricant 31 interspersed therewith and therebetween producing a compoundless buff 23 of the present invention configured for abrasively treating or finishing a surface, workpiece, object, or the like without any buffing or polishing compound being applied.

In a preferred method of making a compoundless buff 23 in accordance with the present invention, method steps are carried out to make an abrasive-containing flowable aqueous compoundless buffing article coating solution 34 containing a binder 29, abrasive 33, and a lubricant 31. When the method is completed, and all of the constituents of the coating solution are added such that the coating solution is finished, the finished coating solution is applied wet or in liquid form onto fibrous material 26 of the buff 23, where it cures to form a relatively hard binder, abrasive, and lubricant-containing coating 27. This coating 27 not only contains lubricant 31 that lowers friction during use of the buff 23, the coating 27 also contains abrasive 33 bonded to fibrous material 26 of the buff 23 by binder 29 thereby imparting the ability to abrasively remove material without use of any separately applied buffing or polishing compound.

Abrasive 33 bonded the fibrous material 26 by binder 29 abrasively engages the surface being treated by the buff 23 abrasively removing material therefrom without the use of any buffing or polishing compound. Lubricant 31 interspersed between the binder 29 and abrasive 33 reduces the friction between the working face 28 of the compoundless buff 23 to which the coating 27 is adhered and the surface being abrasively treated using the buff 23.

Such a compoundless buff 23 of the present invention is advantageously versatile as it is well suited for use in a wide variety of abrasive material removal, abrasive treatment, and surface finishing applications. One preferred compoundless buff 23 of the present invention is configured for use in surface finishing applications, including as a buffing or polishing buff, e.g., floor buffing or polishing buff, used to buff or polish generally flat surfaces such as floors, countertops, slabs, e.g., granite slabs, sheets, e.g., plastic sheets, wafers, e.g., silicon wafers, panels, e.g., glass panels, and the like. Another preferred compoundless buff 23 of the invention is configured for use in abrasively treating and surface finishing three dimensionally shaped or contoured workpieces, such as metal castings, medical components, molded plastic parts, wooden articles, and the like. A still further preferred compoundless buff 23 of the invention can be configured for other types of surface finishing applications, including paint removal, rust removal, slag removal, weld preparation, as well as for other types of surface preparation and surface finishing applications.

With continued reference to FIGS. 1 and 2, compoundless buff 23 is composed of a resilient flexible fibrous polishing or buffing abrasive and lubricant carrier 25 made of at least a plurality of layers **24*a*-24*f* of a porous and/or void-filled nonwoven fibrous material 26, with each layer 24*a*-24*f* having an abrasive substrate 32 extending along and inwardly of an outer edge 30 thereof with the substrates 32 of all the layers 24*a*-24*f* defining a buffing or polishing working face 28. In making compoundless buff 23, an abrasive-containing flowable aqueous compoundless buffing article coating solution is formulated that contains binder 32, abrasive 33, and lubricant 31 that is applied to the substrates 32 of all the layers 24*a*-24*f* of the fibrous abrasive and lubricant carrier 25 forming a relatively hard lubricant and abrasive-containing coating 42 thereon. During coating solution application, at least some of the coating solution, including lubricant 31, abrasive 33, and binder 32 of the coating solution, is absorbed into, wicks into, and/or impregnates the substrates 32 of all the layers 24*a*-24*f* forming a coating 42 that distributes binder 32, abrasive 33 and lubricant 31 within the layers 24*a*-24*f* at each substrate 32 and exteriorly along and on the substrate 32** of each layer

24*a*-24*f*. The result is that application of the coating solution forms such a coating 42 that not only penetrates into the outer edge 30 of each layer 24*a*-24*f*, but which substantially completely covers and substantially completely encases the working face 28 formed by all of the coated substrates 32 of all the layers 24*a*-24*f*.

Compoundless buff 23 is of compoundless construction because application of loose abrasive and/or buffing or polishing compound is not required prior to use of the buff 23. This is because application of such a coating solution containing binder 32, abrasive 33, and lubricant 31 onto the substrate 32 of each layer 24*a*-24*f* of nonwoven cloth produces a lubricant and abrasive-containing coating 42 thereby eliminating the need separate application of any such loose abrasive and/or buffing or polishing compound.

The present invention is directed to a compoundless buff 23, e.g., compoundless buffing article 22, having at least a plurality, preferably at least a plurality of pairs of layers 24*a*-24*f*, i.e., at least three layers, treated by applying an abrasive particle containing flowable aqueous compoundless buffing article coating solution 34 to form a polish or buffing lubricant and abrasives-containing substrate 32 in each treated layer 24*a*-24*f* of the working face 28 of the buff 23. In one embodiment, substantially the entirety of each one of the layers 24*a*-24*f* is treated by applying the coating solution 34 thereto or thereon. As such, it is contemplated that a compoundless buff constructed in accordance with the invention can be manufactured with all of the layers 24*a*-24*f* of the buff having been treated with coating solution 34 by the coating solution 34 having been applied to substantially all of the surface area of each one of the layers 24*a*-24*f*.

A preferred but exemplary compoundless buffing article 22 of the present invention is depicted in FIG. 1 in the form of an annular buff 38, such as a wheel buff, e.g., double-finger wheel buff, an airways buff, or wave-ring buff, like those shown respectively in FIGS. 5, 9, 11, and 12 of commonly owned U.S. Pat. No. 6,595,843, the entirety of which is expressly incorporated by reference herein. Where the buff 38 is of such annular construction, a plurality of such compoundless buffs 38 can be stacked to form a stacked buff roll, such as of the form or construction depicted in FIG. 8 of U.S. Pat. No. 6,595,843 incorporated by reference herein. If desired, a compoundless buffing article 22 constructed in accordance with the present invention can also be configured in the form of a flap wheel, a stitched full disc buff, a radially fingered buff, a flap belt buffing tool, or a buffing belt like those respectively shown in FIGS. 6, 7, 10, 13 and 15 of commonly owned U.S. Pat. No. 6,595,843 incorporated by reference herein but be of compoundless construction. It should be further recognized that a compoundless buffing article 22 constructed in accordance with the present invention can have a different shape, contour, configuration, or modality as it can also be configured as a buffing wheel, a polishing wheel, a buffing disc or disk, a polishing disc or disk, a polishing buff, a tapered buff, a goblet buff, a mushroom buff, or the like but which also is of compoundless construction.

FIG. 2 illustrates an outer peripheral segment of the compoundless buffing article 22, e.g., buff 38, of FIG. 1 showing that it is formed of at least a plurality, preferably a plurality of pairs of, i.e., at least three, layers 24*a*, 24*b*, 24*c*, 24*d*, 24*e*, 24*f* and 24*g* of fibrous polishing or buffing abrasive material carrier 25 each made of nonwoven fibrous cloth or fabric material 26. The outer edge 30 of the outer periphery of at least a plurality of the layers 24*a*, 24*b*, 24*c*, 24*d*, 24*e*, 24*f* and 24*g*, defines a polishing or buffing abrasive-containing substrate 32 having a lubricant and abrasive-containing coating # adhered to from application of a finished abrasive-containing flowable aqueous compoundless buffing article coating solution 34 thereto.

With continued reference to FIG. 2, the lubricant and abrasive-containing coating 42 applied to the substrate 32 of each layer 24*a*-24*f* of the compoundless buff 23 extends from the outer peripheral edge 30 of each layer 24*a*-24*f* and encompasses a margin 35 of the substrate 32 that extends inwardly along the respective layer 24*a*-24*f* a distance from the layer edge 30 and/or working face 28. Where the compoundless buff 23 is a wheel or other annular or round buff, the lubricant and abrasive coated substrate 32 extends from the outer peripheral edge 30 of each treated layer 24*a*-24*f* radially inwardly to the dashed line shown in FIG. 2 that defines the radial inner limit or boundary of substrate margin 35. At least the substrate 32 of each treated layer 24*a*, 24*b*, 24*c*, 24*d*, 24*e*, 24*f* and/or 24*g* of compoundless buff 23 is part of the fibrous polishing or buffing abrasive and lubricant carrier 25 of the buff 23 that is a porous and void-filled fibrous material 26 that preferably is a non-woven cloth made by a fiber-entangling process, such as by needle punching and/or hydro-entanglement. As a result, at least a plurality of pairs, i.e., at least three, pores, and at least a plurality of pairs of relatively small internal voids are formed in at least the substrate 32 of each coated layer 24*a*-24*f* of the buff 23.

During application of abrasive-containing flowable aqueous compoundless buffing article coating solution 34, the numerous pores and internal voids in substrate 32 facilitate penetration and absorption of the coating solution 34, including lubricant 31, abrasive 36, and binder 29, advantageously distributing the lubricant 31, abrasive 36 and binder 29 throughout substantially the entire working face 28 of the buff 23, including the substrate 32 of each layer 24*a*-24*f*. As a result of using such a porous and void filled non-woven cloth or fabric, the applied coating solution 34, including its lubricant 31, abrasive 36 and binder 29, is substantially uniformly externally and internally distributed throughout the working face 28 of the buff 23, including the substrate 32 of each layer 24*a*-24*f*, forming a lubricant and abrasive-containing coating 42 that uniformly covers substantially the entire working face 28 of the buff 23.

In a preferred compoundless buff embodiment, layers 24*a*-24*f* of the buff 23 are formed of a non-woven cloth of entangled fiber construction, e.g., fibrillated construction, with each layer 24*a*-24*f* preferably formed of a needle punched, hydro-entangled, or other type of fiber-entangled nonwoven cloth. Such a nonwoven cloth advantageously produces a compoundless buff 23 that has good toughness, is tear and fray resistant, that prevents tearing and fraying of the buff 23 when buffing metal, especially metal parts with sharp edges and contours. Such a porous, void-filled fibrous nonwoven cloth advantageously produces a compoundless buff 23 that better and more uniformly absorbs applied coating solution into it producing a hard lubricant and abrasive-containing coating 42 which is integral with at least a portion of the substrate 32 of each layer 24*a*-24*f*. Because of having such an entangled fibrous, porous and internal void-filled construction, a greater amount, weight, mass, or number of abrasive particles 33 from the applied coating solution 38 advantageously penetrate into and are distributed throughout the substrate 32 and margin 35 of each layer 24*a*-24*f* coated with the coating solution 38.

This produces coated nonwoven cloth layers 24*a*-24*f* each having a polishing or buffing abrasive-containing substrate 32 carrying at least a plurality of pairs of, i.e., at least three, abrasive particles 36 per cubic millimeter of volume of the substrate 32 when coating is done. This results in coated layers 24*a*-24*f* having a polishing or buffing abrasive-containing substrate 32 that possess a greater density of abrasive particles 33 disposed therein, which advantageously produces a compoundless buff 23 of the present invention that more uniformly polishes or buffs the surface being abrasively treated, more rapidly achieves a desired surface finish, lasts longer, and does so for a wider variety of surface types.

In addition, the entangled fibrous and fibrillated structure of such an entangled fibrous nonwoven material of each layer 24*a*-24*f* being coated with coating solution 38 not only facilitates absorption and retention of abrasive articles 36 and lubricant 31 during coating solution application, it also advantageously provides increased internal surface area within the region, e.g., substrate 32 or margin 35, of each layer 24*a*-24*f* treated thereby increasing the amount, weight, mass and/or number of abrasive particles 36 and lubricant 31 that become distributed throughout and within the substrate 32. As a result, in addition to the abrasive particles 36 and lubricant that become attached, engaged or otherwise adhered to the exterior of the layer(s) 24*a*-24*f* being treated, including those abrasive particles 36 and/or lubricant 31 which become attached, engaged or otherwise adhered to the working face 28 collectively formed by the substrates 32 of the coated layers 24*a*-24*f*, use of such a more porous and internal void-filled entangled fiber non-woven material, preferably a nonwoven cloth, enables more abrasive particles 36 and/or lubricant 31 to become embedded or otherwise entrapped within the substrate 32 of each layer 24*a*-24*f* of the buff 23.

In one preferred embodiment, each coated layer 24*a*-24*f* used to produce a compoundless buffing article 22 of the present invention is made of a viscose material, e.g., viscose rayon, which more preferably is a viscose needle punch non-woven cloth or fabric that not only possesses at least a plurality of the aforementioned properties that makes it well suited for compoundless buffing article use, but which also is flexible, resilient, tough, durable and wear resistant. In one such preferred embodiment, the material used is a viscose non-woven needle punch cloth or fabric that can be and preferably is a non-woven needle-punched viscose rayon that preferably has a weight range of between about 3.3 OSY and about 3.9 OSY. Although such needle punch nonwoven fabrics commonly have a specification weight variation of about 10%, a preferred compoundless buff embodiment uses a viscose needle-punch viscose material, preferably viscose rayon, having a specification weight variation of no greater than about 5% to produce a tougher, more resilient compoundless buff 23 that lasts longer and is more tear and fray resistant.

In another preferred compoundless buffing article embodiment, each coated layer 24*a*-24*f* used to produce a compoundless buff 23 of the present invention is made of an entangled fibrous non-woven material, preferably a needle-punched or hydro-entangled non-woven cloth composed of one or more types of natural, synthetic or semisynthetic fibers, including wool, mohair, cotton, linen, hemp, sisal, polyester, polyamide, polypropylene, polyethylene terephthalate (PET), fiber(s) made of or from an acrylic, and/or fiber(s) made of or from an aramid. In one such preferred compoundless buff embodiment, each coated layer 24*a*-24*f* used to produce a compoundless buff 23 of the invention is composed of one or more such fibers in the form of a nonwoven cloth and made in accordance with that shown and disclosed in commonly owned U.S. Pat. No. 6,595,843, the entirety of which is expressly incorporated by reference herein.

Use of such nonwoven fibrous materials for the layer(s) 24*a*-24*f* of the compoundless buff 23 advantageously resist both tearing and fraying during buffing processes, even when subjected to edges or sharp contours associated with the underlying three-dimensional shape or contour of the surface intended to be polished or buffed. Regardless of the final shape and/or operational modality, such nonwoven fibrous materials are also well suited for use in producing a compoundless buff 23 having the shape of a wheel, a disk, a ball, a sheet, a belt, or another shape, including as discussed above, and which is preferably configured for use in fine polishing or buffing operations without use of extraneous abrasive compounds.

In a preferred embodiment, the substrate margin 35, as indicated by the dashed line in FIG. 2, preferably is at least one millimeter, preferably at least a plurality of millimeters deep or thick, defining a compoundless abrasive substrate 32 at least one millimeter, preferably at least a plurality of millimeters, in depth or thickness. This not only produces a compoundless buff 23 with abrasive particles 36 at or along the outer surface thereof and which preferably at least partially exposed at the working face 28 of the buff 23 which engage the surface being abrasively treated by the buff 23 during polishing or buffing, it also ensures there are other abrasive particles 36 within the substrate 32 disposed below the working face 28 that subsequently replace abrasive particles 36 at the working face 28 as they are consumed, broken free, lost, or worn away during polishing or buffing. The same is true regarding lubricant 31 at the working face 28 as such lubricant 31 is distributed throughout and within the substrate 32, thereby providing sufficient lubricant 31 for at least a thin lubricant film to form on the surface being polished or buffed with the buff 23. Formation of such a lubricant film reduces buffing friction, which advantageously extends the life of the compoundless buff 23 and reduces the force required to buff or polish the surface being treated with the buff 23.

This also occurs during wear of abrasive-containing coating 42 and/or fibers of the nonwoven cloth working face 28, which correspondingly reduces the extent or thickness of the coating 42, substrate 32, and margin 35, such that a compoundless buffing article 22 constructed in accordance with the present invention with such an abrasives-containing coating 42 carried by substrate 32 advantageously possesses improved wear characteristics and increased life as a result. As wear of the buff 23 occurs, the thickness of the coating 42 and/or the margin 35 of the substrate 32 is reduced causing abrasive particles 36 previously embedded in the substrate 32 to become exposed at the working face 28 substantially continuously renewing abrasive material removal capacity of the working face 28. As such wear occurs, additional lubricant 31 within the substrate 32 also is released helping maintain and/or form the desired lubricating film between the working face 28 of the buff 23 and the surface being abrasively treated with the buff 23.

Because the working face 28 substantially continuously becomes renewed by the continuously ongoing exposure of embedded abrasive particles 36 due to wear of the buff 23 and the substantially continuous release of lubricant 31 impregnated within the substrate 32 and layers 24*a*-24*f* that also occurs, the polishing or buffing effectiveness of the buff 23 advantageously is better maintained for a longer period of time. In addition, although some abrasive particles 33 migrate away from and become lost from the working face 28 from wear during polishing or buffing, other abrasive particles 33 can and frequently do remain captive at the buffing or polishing interface formed where the working face 28 contacts the surface being abrasively treated in at least some instances causing performance of the buff 23 to actually improve due to buff wear occurring. Likewise, although some of the lubricant 31 that forms the lubricating film between the working face 28 and the surface being treated by the buff 23 wears away or migrates outwardly of the working face 28, wear of the lubricant and abrasive-containing coating 42 on the working 28 during buffing releases additional lubricant helping maintain and perhaps even strengthen or thicken the film.

The invention also is directed to a method of making a water-based abrasive particle containing flowable aqueous compoundless buffing article coating solution 34 that is applied to at least the outer edge 30 of the substrate 32 of each one of the nonwoven cloth layers 24*a*-24*f* of the buff 23 to form a lubricant and abrasive-containing coating 42 on the working face 28 and substrate 32 of layers 24*a*-24*f* used in manufacturing compoundless buffing article 22. In one preferred method implementation, the coating solution 34 also is applied to the margin 35 of the substrate 32 of each layer 24*a*-24*f* producing a relatively hard lubricant and abrasive containing coating 42 that substantially completely covers, encompasses, is impregnated into and embedded within the margin 35 and outer edge 30 of the substrate 32 of each nonwoven cloth layer 24*a*-24*f* of the buff 23.

As discussed in more detail below, lubricant 31 and binder 29 are blended with abrasive particles 33 and other constituents, including one or more pH regulators, surfactants, viscosity modifiers, suspension agents, emulsion stabilizers, and/or foaming agents, in a specific and desired order to produce a water-based abrasive particle containing flowable aqueous compoundless buffing article coating solution 34 that is applied to the substrate 32 of each nonwoven cloth layer 24*a*-24*f* of the buff 23 to form a lubricant and abrasive-containing coating 42 on the working face 28 of the buff 22 that eliminates the need for use of a separate buffing or polishing compound. Application of the coating solution 34 during coating of the working face 28 of the buff 23 distributes binder 29, lubricant 31 and abrasive particles 33 along and throughout the substrate 32 and margin 35 of each layer 24*a*-24*f* of the buff 23 with the binder 29 bonding the abrasive particles 33 to fibers at and within the substrate 32 and margin 35 of each layer 24*a*-24*f* as the coating 42 cures during drying of the coating 42. During curing of the coating 42, the binder 29 bonds with fibers at and within the substrate 32 and margin 35 of each layer 24*a*-24*f* of the buff 23 and bonds abrasive particles 33 thereto as the binder 29 itself also cures. Where the binder 29 is a self-crosslinking binder, such as preferably a self-crosslinking acrylic binder, self-crosslinking occurs during curing thereby hardening the binder 29 bonding it to abrasive particles 33 and fibers at and within the substrate 32 and margin 35 of each layer 24*a*-24*f* of the buff 23. The lubricant 31 also is distributed along and throughout the substrate 32 and margin 35 of each layer 24*a*-24*f* with lubricant 31 adhering to fibers at and within the substrate 32 and margin 35 of each layer 24*a*-24*f* of the buff 23. Application of the coating solution 34 forms a coating 42 having micelles or regions of binder 29 and abrasive particles 33 interspersed with micelles or regions of lubricant 31. After the coating solution 34 is applied, it cures or hardens into a relatively hard lubricant and abrasive-containing coating 42 having a hardness great enough where a fingernail leaves no impression or an almost imperceptible impression no more than one millimeter deep. Such a cured coating is relatively hard preferably having a Knoop indentation hardness of at least 40, preferably has a Knoop indentation hardness of at least 60, and more preferably has a Knoop indentation hardness of at least 70 thereby producing a relatively hard, durable and wear resistant lubricant and abrasive-containing coating 42 that eliminates the need for separate application of a buffing or polishing compound during compoundless buff use.

If desired, coating solution 34 can be applied to portions or the entirety of nonwoven cloth layers 24*a*-24*f* before the layers 24*a*-24*f* are formed, preferably three-dimensionally formed, into the shape of a buffing article 22, such as a buff, preferably annular disc-shaped compoundless buff 23, but can be formed into another suitable shape for use as a compoundless buff in accordance with the present invention. In one preferred method of making a compoundless buff of the invention, coating solution 34 is applied onto those areas, such as outer edges and margins, corresponding to the substrate 32 and margin 35 of each layer 24*a*-24*f* forming a lubricant and abrasive-containing coating 42 thereon before the layers 24*a*-24*f* are three-dimensionally formed or shaped in the manner depicted in FIGS. 1 and 2 into an annular disc-shaped compoundless buff 23.

With additional reference to FIG. 3, an abrasive-containing flowable aqueous compoundless buffing article coating solution 34 is applied to a layer 24*a*-24*f* of fibrous nonwoven cloth or nonwoven fabric 55 impregnating and embedding binder 29, abrasive particles 33, and lubricant 31 within pores and voids of the layer 24*a*-24*f* and forming a lubricant and abrasive-containing coating 42 thereon when the coating solution 34 cures. At least part of the coating 42 covers the substrate 32 of each layer 24*a*-24*f* to which coating solution 34 is applied, thereby forming a relatively hard abrasive substrate 32' composed of binder 29, lubricant 31 and abrasive particles 33 in the form of a relatively hard cured coating 42 integral formed as part of the substrate 32. As discussed in more detail below, the coating solution 34 has a buffing and/or polishing abrasives-containing polymer binder emulsion and a lubricant emulsion such that the coating solution is formed of a dual-emulsion or two-emulsion system formulated in accordance with another aspect of the present invention that is made using a method of making the coating solution 34 in accordance with a further aspect of the present invention.

With reference to the tables below, an abrasive-containing flowable aqueous compoundless buffing article coating solution 34 can be and preferably is composed of an aqueous base to which an abrasive, a lubricant emulsion, preferably a polymer lubricant emulsion, and a binder emulsion, preferably a polymer binder emulsion, are added generally in such a desired order with a pH regulator, surfactants, and a viscosity modifier also preferably are added to produce a preferred embodiment of a finished coating solution in accordance with another aspect of the invention. Where part of the coating solution is made at one time or location and the remainder made at another time or location, a suspension agent preferably is added to keep abrasive particles added to the solution suspended in the solution for an extended period of time.

In a preferred implementation of a method of making one such coating solution, a surfactant is added to the aqueous base before abrasive particles are added to ensure the abrasive particles are de-agglomerated and dispersed within the solution when added thereto. A pH regulator that preferably is a buffering agent also is added to the solution before the abrasive particles to buffer any change in pH of the solution caused by the addition of the abrasive particles to maintain the flowability of the solution and prevent gelling of the solution. In a preferred method implementation and coating solution formulation, a pH regulator that preferably is a buffering agent is added to the aqueous base before surfactant and abrasive particles are added. The surfactant is added before adding the abrasive particles to ensure de-agglomeration and dispersal of the abrasive particles within the solution as the abrasive particles are added to the solution.

In one such preferred method implementation and coating solution formulation, the order these constituents are added is critical because the pH regulator that is a buffering agent buffers any changes in pH of the solution toward becoming more acidic caused when the abrasive-dispersing surfactant and abrasive particles are added. The surfactant is added after the pH regulator and before adding the abrasive particles to ensure the abrasive particles are de-agglomerated and dispersed within the solution preferably as the abrasive particles are added to the solution.

Where the partly finished solution, e.g., slurry 40, is to be stored or transported before the rest of the constituents are added to produce the finished coating solution, a suspension agent preferably is added to the partly finished solution to help keep the abrasive particles suspended in the solution for at least one day, preferably at least a plurality of days, until the rest of the constituents can be added to the solution to produce a finished coating solution ready to be applied.

In one preferred method implementation and coating solution formulation, partly finished solution, e.g., slurry 40, contains a polishing or buffing lubricant, preferably in the form of a lubricant emulsion, abrasive particles 33, and one or more other constituents to which additional constituents, including a binder, preferably in the form of a binder emulsion, are added to form a viscous and flowable coating solution ready to be applied to one or more layers of nonwoven cloth in making a compoundless buff 23 of the invention. The primary constituents of such a coating solution 34 include polishing or buffing abrasives, in the form of abrasive particles 33, lubricant, in the form of a water-emulsifiable polymer lubricant, preferably in the form of a polymer lubricant emulsion, and a binder, in the form of a water-emulsifiable polymer binder, preferably in the form of a polymer binder emulsion, producing a dual-emulsion coating solution of the present invention. Such a dual-emulsion coating solution cures as it dries forming a relatively hard coating 42 containing abrasives bonded by the binder to fiber of nonwoven cloth of the buff 23 and a lubricant imparting buffing friction reducing lubricity to the coating 42.

The abrasive particles 33 are formed of a high hardness abrasive material having a hardness of at least 8.5 on the Mohs scale and a surface area no greater than 14 square meters per gram. In a preferred coating solution formulation, abrasive particles 33 used in polishing or buffing abrasive treatment material 34 preferably are made of calcined aluminum oxide, i.e., $Al_2O_3$, or aluminum (III) oxide having a relatively small or fine specification or particle size ranging between about 0.5 micron and about 45 microns, and a median particle size of between about 2 microns and about 5 microns. Such relatively small abrasive particle sizes are desired and preferably required for a compoundless buff 23 of the invention made with abrasive-containing coating formed by application of an abrasive particle and binder containing coating solution to be used in buffing and polishing applications.

As known in the industry, aluminum oxide is calcined by firing it at a suitably high temperature to calcine it before then being milled to a given abrasive particle size specification or range, preferably in accordance with that disclosed herein, producing abrasive particles 33 having a desirably small size suitable for polishing or buffing when bonded by binder to the nonwoven cloth of the compoundless buff 23. If desired, sieving, screening, or another particle size separation or classification method can be done to obtain a sufficient amount of relatively finely-sized calcined aluminum oxide abrasive particles 33 having a particle size range of between 0.5 micron and 45 microns and a median particle size of between 2 and 5 microns. The pH of the abrasive particles 33 made of calcined aluminum oxide is preferably in the range of about 8 pH to about 10 pH with a preferred abrasive particle pH value falling between about 9.3 and about 9.4. Maintaining such an alkaline range helps maintain the pH of the emulsion or polishing or buffing abrasive treatment material 34 within a desired pH range of 8 and 9 to optimize its ability to remain flowable during coating application and thereafter dry or cure to a relatively hard lacquer-like coating that bonds well to the working face 28 of the buff 23. Maintaining the coating solution within this desired pH range also produces a dried, cured or hardened coating that has a hardness high enough to bond well but which still has lubricity that reduces friction between the working face 28 of the buff 23 and the surface being abrasively finished that is in contact with the working face 28.

If desired, a coating solution 34 can be formulated in accordance with one aspect of the present invention to have abrasive particles 33 and 33' of more than one size and/or type of abrasive material with the sizes and/or types of abrasive particles 33 and 33' selected or specified a function of the intended finish quality to be achieved with the resultant compoundless buff 23 made with the abrasive particles 33 and 33'. In one such preferred formulation, the coating solution 34 contains a mixture of calcined aluminum oxide abrasive particles 33 and chromium oxide abrasive particles 33' producing a compoundless buff 23 of the invention that imparts a smoother and/or more polished finish to a surface abrasively treated with the buff 23. Where the coating solution 34 contains a mixture of different abrasives, the abrasive particles 33 of one type of abrasive, e.g., calcined aluminum oxide particles 33, have a size different than the size of the abrasive particles 33' of another type of abrasive, e.g., chromium oxide abrasive particles 33'. Where chromium oxide abrasive is used, the chromium oxide particles 33' preferably are smaller in size than the aluminum oxide particles 33, with the chromium oxide particles 33' preferably having a particle size or specification size ranging from about 0.1 micron to about 10 microns and a median particle size of less than about 1 micron. For even more stringent or finer surface finishing applications, it is contemplated that another preferred coating solution 34 can be formulated to contain only chromium oxide abrasive particles 33' producing a compoundless buff 23 that imparts an even more polished and/or smoother finish to the surface abrasively treated with the buff 23.

In a preferred method of making a water-based abrasive particle containing flowable aqueous compoundless buffing article coating solution in accordance with the present invention used to coat the working face 28 of the buff 23 forming a water-based relatively hard lubricant, binder and abrasive-containing coating 42 on the working face 28 of the buff 23. With reference to FIG. #, a predetermined amount of water is measured or provided that forms an aqueous base of the coating solution to which a pH regulator that preferably also is a buffering agent is added in a pH regulating step to maintain flowability of the coating solution before a nonionic abrasive-particle dispersing surfactant is added in a surfactant adding step in preparation for subsequent addition of abrasive in abrasive adding step that are added in the form of relative small abrasive particles before a lubricant is added in a lubricant adding step in the form of a nonionic lubricant polymer emulsion. Where the solution is going to be stored or transported to another location where subsequent additional steps of the method of making the coating solution are going to be performed, a suspension agent is added to the solution forming a slurry in a suspension agent adding step to help keep the surfactant-dispersed abrasive particles suspended in the solution by preventing the abrasive particles from settling out of the slurry. Where the coating solution method continues substantially uninterrupted, there is no need to add a suspension agent nor perform the suspension agent adding step.

After the abrasive adding step and after any suspension agent step is performed, a binder adding step is performed to add binder in the form of a binder emulsion that provides a binder when the finished coating solution is applied to the working face 28 of the buff 23 forming a coating 42 that hardens as it cures causing abrasive particles 36 to be bonded thereto. Addition of the binder emulsion produces a dual-emulsion coating system and coating solution having the binder emulsion and the lubricant emulsion together in the same coating solution. Following addition of the binder emulsion in binder adding step, one of a viscosity modifying step, e.g., thickening step, and emulsion stabilizing step is performed to add a viscosity modifier to the solution that thickens or decreases the viscosity of the solution that thereby also helps stabilize the lubricant emulsion and the binder emulsion of the solution. Also to help stabilize the emulsions, a second surfactant is added after adding the binder emulsion in a surfactant adding step with the second surfactant helping to keep the lubricant of the lubricant emulsion and the binder of the binder emulsion dispersed and suspended in the solution. Addition of both the viscosity modifier and the second surfactant are performed after adding the binder emulsion with addition of one or both the viscosity modifier and second surfactant producing a finished coating solution that is ready to be applied to a portion of the nonwoven cloth of the buff 23 that forms at least part of the working face 25 of the buff 23.

Where the finished coating solution is applied using a foam applicator, a preferred implementation of a method of making the coating solution of the present invention includes at least the additional step of adding a foaming agent in a foaming agent adding step. Preferably, such a foam applied coating solution method implementation further includes the step of adding a foam stabilizing agent in a foam stabilizer step before the foam applied coating solution of the invention is completed.

With regard to the tables below, Tables 1A, 1B and 2 disclose preferred formulations of one component of a coating solution 34 of the present invention that is in the form of an incomplete intermediate solution or slurry 40 to which (i) a second component of an incomplete intermediate solution or slurry containing the additional constituents listed in Table 3 is blended, or (ii) additional constituents, such as those listed in Table 3, are added to form a finished coating solution 34. Either way, where such an incomplete intermediate solution is formed that contains less than all of the constituents required to produce a finished coating solution, a suspension agent preferably is used to keep each emulsion in the incomplete intermediate solution suspended.

TABLE 1A

First Slurry Formulation with Aluminum Oxide Abrasive Particles, Organic Surfactant & Suspension Agent

| Constituents | CAS | Weight % |
|---|---|---|
| Aluminum Oxide Abrasive Particles | 1344-28-1 | 35-60% |
| Fatty Acid/Glyceride Surfactant | | 1-5% |
| Suspension Agent Triethanolamine Oleate | 2717-15-9 | 4-10% |
| Water Aqueous Base | 7732-18-5 | 35-55% |

Table 1A above identifies constituents of a first preferred formulation of an abrasive-containing incomplete intermediate solution or slurry formed of an aqueous base that contains between 35% and 55% water by weight of a first intermediate solution or slurry. The intermediate solution or slurry also contains aluminum oxide particles 33 suspended by a nonionic organic surfactant, preferably in the form of a fatty acid or glyceride, such as a polyglycerol ester, which is added to the solution in a surfactant adding step in an amount of between 1% and 5% by weight of the intermediate solution or slurry before abrasive particles 33 are added in an abrasive particle adding step in an amount of between 35% and 60% by weight of the intermediate solution or slurry. The surfactant is added before the abrasive particles 33 are added to de-agglomerate and disperse the abrasive particles 33 preferably as they are added to the solution or slurry.

Such an intermediate solution or slurry preferably contains enough aluminum oxide particles 33 to produce a compoundless buff 23 in accordance with the present invention where the abrasive-containing coating has at least 55% aluminum oxide particles 33 by dry coating weight, preferably contains between 60% and 70% aluminum oxide particles 33 by dry coating weight, and preferably contains between 66%±2% aluminum oxide particles 33 by dry coating weight.

Although not listed in Table 1A above, the intermediate solution or slurry can also contains a lubricant, preferably a polymer lubricant resin, more preferably a lubricant emulsion, and more preferably a polymer lubricant resin emulsion, which preferably is composed of a relatively hard polyethylene resin which more preferably is a high-density polyethylene resin, which is added to the solution or slurry in a lubricant emulsion adding step in an amount between 5% and 10% by weight of the intermediate solution or slurry. In a preferred solution or slurry formulation, polyethylene resin that preferably is high-density polyethylene resin is added to the solution or slurry in an amount between 5% and 10% by weight of the intermediate solution or slurry.

The intermediate solution or slurry preferably also contains a suspension agent that preferably is a triethanolamine oleate added in a suspension agent adding step preferably performed after the surfactant was added in the surfactant adding step and the abrasive particles 33 were added in the abrasive particle adding step. An amount of the suspension agent, preferably triethanolamine oleate, is added to the intermediate solution or slurry to help keep the abrasive particles 33 already added to the suspension or slurry suspended therein during storage and/or transport. Where all of the constituents of the coating solution are added at the same location during the same coating making procedure, such a suspension agent may not be needed or used.

The remainder of the intermediate solution or slurry is formed of its aqueous base that is composed of between 35% and 55% water by weight of the intermediate solution or slurry.

To produce a finished coating solution 34 of the present invention, the constituents listed in Table 3 are added to the intermediate solution or slurry containing the constituent formulation set forth above in Table 1A.

TABLE 1B

First Slurry Formulation with Aluminum Oxide Abrasive Particles, Buffering Agent & Lubricant Emulsion

| Constituents | CAS | Weight % |
|---|---|---|
| Aluminum Oxide Abrasive Particles | 1344-28-1 | 35-60% |
| Polyethylene Glycol Octylphenyl Ether Surfactant | 9002-93-1 | 0.5-5.0% |
| Polyethylene Resin Lubricant | 9002-88-4 | 4-9% |
| Sodium Borate Buffering agent | 1303-96-4 | 0.5-2.0% |
| Water Aqueous Base | 7732-18-5 | 35-55% |

Table 1B above identifies constituents of a second preferred formulation of an abrasive-containing incomplete intermediate solution or slurry formed of an aqueous base that contains between 35% and 55% water by weight of a second intermediate solution or slurry. The intermediate solution or slurry also contains a buffering agent added in a buffering agent adding step that preferably is a pH regulator or pH adjuster in the form of sodium borate, e.g., borax, in an amount sufficient to keep the pH of solution or slurry from becoming too acidic to help maintain flowability by preventing gelling of the solution, slurry and finished coating solution. In a preferred solution or slurry formulation, between 0.5% and 2.0% by weight of the intermediate solution or slurry of such a buffering agent that preferably also is a pH regulator or pH adjuster, preferably sodium borate, e.g., borax, is added during the buffering agent adding step. The addition of such a buffering agent in such an amount to the intermediate solution or slurry is sufficient to keep the pH of the intermediate solution or slurry within a range of between 8.5 and 9.4 and preferably keep the intermediate solution or slurry within an ideal pH of about 9.1±0.2. It is desired, even essential, to regulate the pH of the slurry 40 to keep within this range and preferably close to the aforementioned pH in order to keep the pH of the finished coating solution 34 within a pH range of between 8.1 and 9.1 and preferably about 8.7 pH±0.2. The pH of the solution is balanced to be between 8.1 and 9.1 to disperse the abrasives and provide compatibility with the lubricant emulsion.

The solution or slurry also contains aluminum oxide particles 33 suspended by a nonionic surfactant, preferably in the form of a polyethylene glycol octylephenyl ether nonionic surfactant, e.g., TRITON X-100 nonionic surfactant, which is added to the solution in a surfactant adding step in an amount of between 0.5% and 5% by weight of the intermediate solution or slurry before the abrasive particles 33 are subsequently added in an abrasive particle adding step in an amount of between 35% and 60% by weight of the intermediate solution or slurry. The surfactant is added before the abrasive particles 33 are added to de-agglomerate and disperse the abrasive particles 33 preferably as they are added to the solution or slurry.

It is contemplated that nonionic surfactants other than polyethylene glycol octylephenyl can be added during the surfactant adding step. Other suitable nonionic surfactants that also could be added during this method step include an alkylphenol ethoxylate, an octylphenol ethoxylate, an octylphenol polyethoxylated, and a linear alcohol ethoxylate all of which can be added during the surfactant adding step in an amount between 1% and 6% by weight of the intermediate solution of slurry.

Such an intermediate solution or slurry preferably contains enough aluminum oxide particles 33 to produce a compoundless buff 23 in accordance with the present invention where the abrasive-containing coating has at least 55% aluminum oxide particles 33 by dry coating weight, preferably contains between 60% and 70% aluminum oxide particles 33 by dry coating weight, and preferably contains between 66%±2% aluminum oxide particles 33 by dry coating weight.

The intermediate solution or slurry preferably also contains a lubricant, preferably a polymer lubricant resin, more preferably a lubricant emulsion, and more preferably a polymer lubricant resin emulsion, which preferably is composed of a relatively hard polyethylene resin which more preferably is a high-density polyethylene resin, which is added to the solution or slurry in a lubricant emulsion adding step in an amount between 4% and 9% by weight of the intermediate solution or slurry. In a preferred solution or slurry formulation, polyethylene resin that preferably is high-density polyethylene resin is added to the solution or slurry in an amount between 4% and 9% by weight of the intermediate solution or slurry.

Where the intermediate solution or slurry is going to be transported to another location or stored such that a period of time will elapse before the remainder of the constituents will be added to form the completed coating solution, a suspension agent, such as a gum, preferably xanthan gum, is added in an amount sufficient by weight of the intermediate solution or slurry that helps keep the abrasive particles suspended in the solution or slurry for at least one day, preferably at least a plurality of days, and more preferably at least a plurality of pairs, i.e., at least three, days before the remainder of the constituents are added. Although a suspension agent is not listed above in Table 1B, where a suspension agent is used, the amount of suspension agent added to the intermediate solution or slurry preferably is between 2% and 12% by weight of the intermediate solution or slurry.

The remainder of the intermediate solution or slurry is formed of its aqueous base composed of between 35% and 55% water by weight of the intermediate solution or slurry.

To produce a finished coating solution 34 of the present invention, the constituents listed in Table 3 can be and preferably are added to the intermediate solution or slurry containing the constituent formulation set forth above in Table 1B.

TABLE 2

First Slurry Formulation with Aluminum Oxide and Chromium Oxide Abrasive Particles

| Constituents | CAS | Weight % |
|---|---|---|
| Aluminum Oxide Abrasive Particles | 1344-28-1 | 35-50% |
| Chromium Oxide Abrasive Particles | 1308-38-9 | 4-8% |
| Fatty Acid/Glyceride Surfactant | | 4-10% |

TABLE 2-continued

| First Slurry Formulation with Aluminum Oxide and Chromium Oxide Abrasive Particles | | |
|---|---|---|
| Constituents | CAS | Weight % |
| Triethanolamine Oleate Suspension Agent | 2717-15-9 | 4-10% |
| Water Aqueous Base | 7732-18-5 | 35-50% |

Table 2 above identifies constituents of a third preferred formulation of an abrasive-containing incomplete intermediate solution or slurry formed of an aqueous base that contains between 35% and 50% water by weight that contains a plurality of different types of abrasive particles, namely, abrasive particles of calcined aluminum oxide and abrasive particles of chromium oxide. Before adding the abrasive particles, a surfactant adding step is performed where a nonionic surfactant, such as a nonionic organic surfactant, preferably in the form of a fatty acid or glyceride, such as a polyglycerol ester, is added to the intermediate solution or slurry in an amount between 4% and 10% by weight of the intermediate solution or slurry to de-agglomerate and disperse both types of abrasive particles when added to the solution or slurry. If desired, a different nonionic surfactant, such as polyethylene glycol octylephenyl ether, an alkylphenol ethoxylate, an octylphenol ethoxylate, an octylphenol polyethoxylated, and a linear alcohol ethoxylate can instead be added in amount between 1% and 7% by weight of the intermediate solution or slurry to de-agglomerate and disperse both types of abrasive particles when added to the solution or slurry.

The intermediate solution or slurry preferably also contains a suspension agent, such as triethanolamine oleate, added in a suspension agent adding step that preferably is performed after the surfactant was added in the surfactant adding step and after both types of abrasive particles were added in the abrasive particle adding step. An amount of the suspension agent, preferably triethanolamine oleate, is added to the intermediate solution or slurry sufficient to help keep both types of abrasive particles already added to the suspension or slurry suspended therein for at least one day, preferably at least a plurality of days, and more preferably at least a plurality of pairs, i.e., at least three, days, during storage and/or transport. In a preferred solution or slurry formulation, triethanolamine oleate suspension is added to the solution or slurry in an amount between 4% and 10% by solution or slurry weight. Where all of the constituents of the coating solution are added at the same location during the same coating making procedure, such a suspension agent may not be needed or used.

If desired, a different suspension agent, such as a gum, preferably xanthan gum, can be added instead of the triethanolamine oleate so long as added in an amount sufficient by weight of the intermediate solution or slurry that helps keep both types of abrasive particles suspended in the solution or slurry for at least one day, preferably at least a plurality of days, and more preferably at least a plurality of pairs, i.e., at least three, days before the remainder of the constituents are added. Although a suspension agent is not listed above in Table 1B, where a suspension agent is used, the amount of suspension agent added to the intermediate solution or slurry preferably is between 2% and 12% by weight of the intermediate solution or slurry.

If desired, the intermediate solution or slurry formulation of Table 2 above can also contain a lubricant, such as a polymer lubricant resin, preferably a lubricant emulsion, and more preferably a polymer lubricant resin emulsion, which preferably is composed of a relatively hard polyethylene resin which more preferably is a high-density polyethylene resin, which is added to the solution or slurry in a lubricant emulsion adding step in an amount between 4% and 9% by weight of the intermediate solution or slurry. In a preferred solution or slurry formulation, polyethylene resin that preferably is high-density polyethylene resin is added to the solution or slurry in an amount between 4% and 9% by weight of the intermediate solution or slurry.

If desired, the intermediate solution or slurry formulation of Table 2 above can also include a pH adjuster or buffering agent, preferably an amine alcohol or borax, in an amount or weight percent range in accordance with that disclosed above in Tables 1A and/or 1B sufficient to maintain the pH of the slurry within the above-disclosed 8.5-9.4 pH range and preferably maintain the pH at about 9.1.

The remainder of the intermediate solution or slurry is formed of its aqueous base composed of between 35% and 50% water by weight of the intermediate solution or slurry.

To produce a finished coating solution of the present invention, the constituents listed in Table 3 can be and preferably are added to the intermediate solution or slurry containing the constituent formulation set forth above in Table 2.

TABLE 3

| Constituents Added to Produce Finished Coating Solution | |
|---|---|
| Constituents | Weight % |
| Thickener Carboxymethyl Cellulose | 0.2-0.5% |
| Aqua Ammonia | 1-2% |
| Foam Stabilizers | 2-5% |
| Surfactants | 2-7% |
| Acrylic Binder | 12-24% |
| Slurry from Table 1A, 1B or 2 | ≈42% ± 3% |
| Water Aqueous Base | 35-45% |

Table 3 above identifies additional constituents, including binder, added to the intermediate solution or slurry of Table 1A, Table 1B or Table 2 to produce a finished coating solution that can be applied onto portions of fibrous nonwoven cloth of a buff to then cure and form a relatively hard abrasive-containing coating that preferably also contains a buffing-friction reducing lubricant. While the constituents listed above in Table 3 can simply be added in sequential steps to the intermediate solution or slurry of Table 1A, 1B or 2, a plurality of the constituents, preferably substantially all of the constituents can be premixed in an aqueous base to form a second intermediate solution of second slurry that is then blended or mixed with the intermediate solution or first slurry of one of Table 1A, 1B or 2 to form a finished coating solution formulated in accordance with the present invention that is then applied to the working face of a nonwoven cloth buffing article to form a relative hard lubricant and abrasive-containing coating producing a compoundless buff in accordance with the present invention.

One of the additional constituents is a binder that preferably is an emulsifiable binder or binder emulsion added in a binder emulsion adding step. As with the polishing or buffing lubricant, e.g., lubricant emulsion, the binder preferably is in the form of a polymer binder, preferably a polymer resin binder, with constituents of the first slurry and constituents listed in Table 3 above added in order to form a viscous flowable coating solution 34 of the present invention that is applied to form a lubricant and abrasive-containing coating of a compoundless buff of the present invention.

A preferred polymer resin binder is an acrylic resin binder added to the solution to at least cause the abrasive particles 36 and/or 36' to adhesively bond to fibers of the substrate 32 of each layer 24*a*-24*f* of the non-woven cloth forming the working face when the finished coating solution is applied to the substrate 32 and layers 24*a*-24*f*. At least 12% acrylic binder, preferably at least 15% acrylic binder, and more preferably at least 18% acrylic binder is added by weight of the finished coating solution 34. In a preferred embodiment, between 12% and 24% acrylic binder is added by weight of the coating solution 34. Where not previously added to the first slurry of Table 1A, 1B or 2, a lubricant, preferably polyethylene polymer resin, preferably high-density polyethylene, and/or a pH adjuster, such as an amine alcohol or borax, is added in respective lubricant adding and pH adjuster or buffering agent adding steps.

In performing a preferred method of making a coating solution 34, e.g., of the present invention, a two-step polymer emulsion process is carried out with a first polymer, preferably a polymer resin lubricant, more preferably polyethylene resin, more preferably a high-density polyethylene, is emulsified in the slurry of Table 1A, 1B or 2 before a second polymer, preferably a polymer resin binder, more preferably an acrylic resin, even more preferably a self-crosslinking acrylic resin, is emulsified in producing the finished coating solution 34. When finished, the coating solution 34 is a water-based polymer emulsion that contains both a water-soluble polymer lubricant, e.g., polymer resin binder, namely polyethylene resin, and a water-soluble polymer binder, e.g., polymer resin binder, namely acrylic resin, which is applied to the substrate 32 as a liquid, flowable or wet coating. When applied, the viscous flowable coating solution 34 is absorbed through the pores into the internal voids formed by or in the fibrous substrate 32 thereby covering fibers of the nonwoven cloth substrate 32 with coating solution 34.

The applied coating solution 34 hardens as it dries and/or cures into a relatively hard water-resistant lacquer-like coating 42. During application, abrasive particles 33 and/or 33' are also carried through these pores into internal voids within the substrate 32 substantially uniformly distributing abrasive particles 33 and/or 33' throughout the substrate 32. When hardening or curing is finished, the hardened or cured lacquer-like compoundless buff coating 42 not only contains abrasive particles 33 and/or 33' bonded by the acrylic binder to fibers on the inside and outside of the substrate 32 of the nonwoven cloth layers 24*a*-24*f*, but the coating 42 itself also contains polishing or buffing lubricant 31 that helps lubricate the surface being polished or buffed using the compoundless buff 23.

With continued reference to Table 3 above, one of these additional constituents is a suspension agent that preferably is a viscosity modifier or thickener that also can function as an emulsion stabilizer. One preferred suspension agent that also is a viscosity modifier or thickener that can and preferably does also function as an emulsion stabilizer in the solution or slurry of Table 1A, 1B or 2, is a cellulosic suspension agent, preferably a natural cellulosic suspension agent, which more preferably is a cellulose or gum, which more preferably is carboxymethyl cellulose or cellulose gum. Although also a suspension agent, carboxymethyl cellulose or cellulose gum is added in an amount primarily sufficient to adjust and maintain proper viscosity of the coating solution 34 to produce a coating solution 34 that is flowable and which is readily applied onto the substrate 32 of each nonwoven cloth layer 24*a*-24*f* and which also is easily absorbed into the substrate 32 of each layer 24*a*-24*f*. In a preferred embodiment, at least 0.1%, preferably at least 0.2%, and more preferably at least 0.3% carboxymethyl cellulose or cellulose gum is added by weight of the second slurry of Table 3. In one preferred embodiment, between about 0.2% and 0.5% carboxymethyl cellulose is added by weight of the second slurry of Table 3.

Another constituent listed in Table 3 that preferably is added is a foaming agent that can be and preferably also is an adhesion promoter that helps promote adhesion of polymer resin in the coating solution 34 to fibers of the nonwoven cloth substrate 32 during application of the coating solution 34 thereto or thereon using a foam applicator as known in the art. A preferred foaming agent that can and preferably also does serve as an adhesion promoter is aqua ammonia or ammonium hydroxide added in an amount sufficient not only to function as a foaming agent but also to facilitate or help facilitate dispersion and suspension of the relatively small or finely sized abrasive particles 36 or 36' in the resultant double-polymer emulsion substrate treatment material 34 produced when the method of making the substrate treatment material 34 is completed. Aqua ammonia is a preferred foaming agent because it can further function as an acidity regulator to help control the pH of the resultant substrate treatment material 34 when mixing of the double-polymer emulsion is completed in making the finished substrate treatment material 34. In a preferred method and substrate treatment material 34, at least 0.75%, preferably at least 1%, and more preferably at least 1.0-2.0% of an acidity regulator that preferably is aqua ammonia that also is a foaming agent that is added by total weight of the coating solution 34. In a preferred embodiment, between 1% and 2% of aqua ammonia is added by total weight of the coating solution 34 to regulate acidity and function as a foaming agent.

One or more foam stabilizers can be and preferably also are added during this second stage of making the coating solution 34. Where added, the foam stabilizer(s) help control bubble formation or foaming in the emulsion in a manner that promotes the introduction of the abrasive, binder treatment to the substrate in an even controlled manner. Preferably one or more such foam stabilizing agents are added in an amount of at least 1.5%, preferably at least 2%, and more preferably at least 2.5% is added as a component or constituent of the coating solution 34 by weight of the coating solution 34. In a preferred embodiment, between 2% and 5% of at least one foam stabilizing agent, e.g., one or more foam stabilizing agents, is added by weight of the coating solution 34.

Where a foam applicator is not used to apply the coating solution 34 onto the substrate 32 of each nonwoven cloth layer 24*a*-24*f* that makes up a compoundless buff 23 of the present invention, neither a foaming agent nor a foam stabilizer is needed nor is either one preferably used. In one preferred method implementation and embodiment of a coating solution 34 of the invention, such as where conventional liquid spray nozzles are used to apply the substrate treatment material 34, the coating solution 34 contains no foaming agent and contains no foam stabilizer.

One or more surfactants can be and preferably also are added during this second stage of making the coating solution 34. Where added, the surfactant(s) help facilitate dispersion and/or suspension of one or both of the polymer emulsions or polymer resins, e.g., one or both the (i) lubricant emulsion, preferably the polyethylene polymer resin lubricant and/or (ii) the binder emulsion, preferably the acrylic polymer resin binder, and preferably also help disperse and/or suspend the abrasive particles 36 and/or 36' in the finished coating solution 34. One or more of these surfactants added during this second stage of making the double-polymer emulsion coating solution 34 can and preferably do also facilitate surface wetting and/or wicking of the coating solution 34 into the fibrous nonwoven cloth substrate 32 when applied thereto during treatment facilitate more rapid and even distribution of the coating solution 34 throughout the substrate 32 of the compoundless buff 23. Preferably one or more such surfactants are added in an amount of at least 1.5%, preferably at least 2%, and more preferably at least 3% by weight of the coating solution 34. In one preferred embodiment, at least one surfactant, e.g., surfactant or one or more surfactants, is added to the coating solution 34 and/or to provide such surfactant(s) in an amount of between 2% and 7% by weight of the solution 34.

With continued reference to Table 3 above, a preferred formulation of the double-polymer emulsion coating solution 34 can include a "green slurry" added in an amount of at least 35% by weight of the coating solution 34 and which is preferably added in an amount of about 42%±5% by weight of the solution 34. Such a "green slurry" can be formed with or include the constituents of Table 1A, 1B or 2 and contain abrasive, e.g. abrasive particles 33 and/or 33', any binder, e.g., binder emulsion, such as acrylic binder or acrylic binder resin, any lubricant, e.g., lubricant emulsion, such as polyethylene lubricant or high-density polyethylene, along with any suspension agents, e.g., surfactants. In a preferred coating solution embodiment, a green slurry is used that contains chromium oxide and/or aluminum oxide abrasives, e.g., chromium oxide and/or aluminum oxide abrasive particles, and a lubricant or lubricating additive and is added to the to the emulsion containing the acrylic binder, e.g., acrylic binder resin, and suspending additives, e.g. surfactant(s). In one such preferred embodiment, the green slurry contains chromium oxide and/or aluminum oxide abrasives, e.g., chromium oxide and/or aluminum oxide abrasive particles and a lubricant or lubricating additive and is added to the coating solution 34 in making the coating solution 34.

Where not added to a slurry of Table 1A, 1B or 2, buffing lubricant can be added at this stage that preferably a lubricating polymer resin, preferably a polyethylene polymer resin, which is added in an amount sufficient to treat, e.g., coat, the substrate 32 during treatment with a sufficient amount of polishing or buffing lubricant that helps provide a film or layer of lubricant between the compoundless buffing article 22 and the surface being polished or buffed by the buff 23. Where not added to such a slurry of Table 1A, 1B or 2, a pH adjuster that preferably is an amine alcohol or borax added in an amount sufficient to keep the pH of the resultant coating solution 34 within a range of between 8.5 pH and 9.4 pH and preferably keep the pH within an ideal pH of about 9.1. It is desired, even essential, to regulate the pH of the coating solution 34 to keep it within this range and preferably close to the aforementioned pH in order to maintain compatibility of the lubricant and resin, control viscosity of the solution and suspend the abrasive particles evenly within the solution. Where a pH adjuster, preferably an amine alcohol, is added at this stage in making the coating solution 34, it preferably is added in an amount of at least 0.3%, preferably at least 0.5% and more preferably at least 1% by weight to the coating solution 34. In a preferred embodiment where a pH adjuster is added, between 0.5% and 2.0% of a pH adjuster is added to the coating solution 34 by weight.

As with such a slurry of Table 1A, 1B or 2, the coating solution 34 also has a liquid base that preferably is an aqueous base such that, after all constituents are added, the remainder of the double-polymer emulsion that forms the coating solution 34 preferably is composed of water. Where formed of an aqueous emulsion base, double-polymer emulsion coating solution 34 preferably is composed of at least of at least 30% water, preferably at least 35% and more preferably at last 40% water by emulsion weight with coating solution 34 preferably containing between 35% and 45% water by weight.

FIG. 3 illustrates an exemplary applicator apparatus 46 for applying, preferably coating, the coating solution 34 onto at least one-layer **24*a*-24*f* of resilient flexible fibrous polishing or buffing abrasive and lubricant carrier 25 made of a porous and void-filled fibrous material 26 that preferably is of non-woven cloth or fabric of fiber-entangled construction as described above. The coating solution applicator apparatus 46 can be located at or after the finish end of a non-woven cloth or fabric manufacturing apparatus 48, such as depicted in FIG. 3, to treat the non-woven layer 24*a*-24*f*** as it is being discharged therefrom.

FIG. 3 illustrates a suitable and exemplary non-woven cloth or fabric manufacturing apparatus 48 has a fiber-entangling mechanism 50, which compacts a web of fibrous material 26 into a more densified web 60 whose fibers are entangled by fiber-entangling mechanism 50 before being discharged as non-woven layer **24*a*-24*f* from the finish end of the apparatus 48**.

With continued reference to FIG. 3, a preferred non-woven cloth or fabric manufacturing apparatus 48 is a needle loom 55 equipped with a fiber entangling needle punch mechanism 52 disposed downstream of a plurality of spaced apart and opposed feed rolls 54, 56 of a web feeder 58. The web of fibrous material 26 preferably is compacted by the feed rolls 54, 56 into a more densified fibrous web 60 whose fibers are entangled by the needle punch mechanism 52 before being discharged by finish end draw off rolls 62, 64 as non-woven cloth or fabric layer **24*a*-24*f*. Needle punch mechanism 52 includes a drive 66 that reciprocates a beam carrying a needle board containing outwardly extending hooked and/or barbed felting needles which reciprocate up and down through upper and lower hole-plates 68, 70 and the compacted web 60 passing generally horizontally therebetween entangling fibers of the web 60 forming non-woven layer 24*a*-24*f***.

As previously discussed, non-woven layer **24*a*-24*f* can be formed using a different fiber entanglement process, including the hydro-entanglement process shown and disclosed in commonly owned U.S. Pat. No. 6,595,843, the entirety of which is expressly incorporated by reference herein. It is contemplated that fiber-entangled non-woven layer 24*a*-24*f*** can be formed using another type of non-woven cloth or fabric material manufacturing apparatus or process employing a similar or even different fiber entanglement apparatus or process.

With continued reference to FIG. 3, the non-woven cloth or fabric layer **24*a*-24*f* is then passed between applicators 72, 74, which can be in the form of foam applicators, spray nozzles or the like, of applicator apparatus 46 which apply the coating solution 34 in liquid form, preferably applied wet as a coating that penetrates or is absorbed by layer 24*a*-24*f* thereby treating the layer 24*a*-24*f* with the lubricant, binder and abrasive-containing coating solution 34. After treatment, treated layer 24***a*-24*f* is formed with one or more treated layers 24*a*-24*f* into a compoundless buffing article 22 in accordance with the present invention that preferably is a compoundless buff 23 or the treated layers 24*a*-24*f* wound up into a roll (not shown) for shipment to another location where treated layer 24*a*-24*f* is unwound and used to make compoundless buffing article 22. If desired, non-woven cloth or fabric layer 24*a*-24*f* can also be wound into a roll (not shown) that is transported to another location and/or separate facility where an applicator apparatus 46 is used to treat the layer 24*a*-24*f* by applying the abrasive polishing or buffing substrate treatment material 34.

While the present invention is directed to a compoundless buffing article 22, e.g., compoundless buff 23, having at least a plurality, preferably at least a plurality of pairs of, i.e., at least three, layers 24*a*-24*f* treated by applying the lubricant, binder and abrasive-contain coating solution 34 to form a polish or buffing abrasives-containing coating 42 on the substrate 32 in each treated layer 24*a*-24*f*, the present invention contemplates treating substantially the entire layer with such a coating solution 34. Likewise, the present invention also contemplates compoundless buffing article 22 being manufactured with all layers 24*a*-24*f* having been substantially completely treated throughout with such a coating solution 34.

Understandably, the present invention has been described above in terms of one or more preferred embodiments and methods. It is recognized that various alternatives and modifications may be made to these embodiments and methods that are within the scope of the present invention. Various alternatives are contemplated as being within the scope of the present invention. It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

It is claimed:

1. A buffing product comprising:

a fabric or cloth formable into a buffing article or buff; and an abrasive adhered to the fabric or cloth of the buffing article or buff;

a lubricant adhered to the fabric or cloth of the buffing article or buff, the lubricant includes a fatty acid glyceride and a polyethylene resin; and wherein the abrasive is comprised of particles of an oxide abrasive mixture including a chromium oxide with a smaller median particle size than an aluminum oxide.

2. The buffing product of claim 1 wherein the abrasive and lubricant are impregnated into the fabric or cloth of the buffing article or buff.

3. The buffing product of claim 2 wherein a binder is configured to adhere the abrasive particles to the fabric or cloth of the buffing article or buff.

4. The buffing product of claim 3 wherein the binder comprises a self-crosslinking acrylic binder.

5. The buffing product of claim 1 wherein the polyethylene resin is high-density polyethylene.

6. A buffing product comprising:

a fabric or cloth formable into a buffing article or buff; and a coating adhered to the fabric or cloth of the buffing article or buff containing an abrasive and a lubricant;

wherein the lubricant includes a fatty acid glyceride and a polyethylene resin; and wherein the abrasive is comprised of at least one of an aluminum oxide having a particle size of between 0.5 microns and 45 microns and a chromium oxide having a particle size of between 0.1 microns and 10 microns; and wherein the abrasive constitutes at least 50 and up to 70 dry wt. % of the coating.

7. The buffing product of claim 1 wherein the fabric or cloth is a non-woven fabric or a non-woven cloth.

8. The buffing product of claim 7 wherein the non-woven fabric or non-woven cloth is a viscose nonwoven fabric material.

9. The buffing product of claim 8 wherein the viscose nonwoven fabric material is a needle punch nonwoven fabric material.

10. The buffing product of claim 6 wherein the coating is impregnated into the fabric or cloth of the buffing article or buff.

11. The buffing product of claim 6 wherein the coating includes a binder.

12. The buffing product of claim 11 wherein the binder comprises a self-crosslinking acrylic binder.

* * * * *